US010195860B2

(12) United States Patent
Kimura et al.

(10) Patent No.: US 10,195,860 B2
(45) Date of Patent: Feb. 5, 2019

(54) LIQUID SUPPLY APPARATUS AND LIQUID CONSUMING APPARATUS

(71) Applicant: Seiko Epson Corporation, Tokyo (JP)

(72) Inventors: Naomi Kimura, Okaya (JP); Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/562,886

(22) PCT Filed: Mar. 30, 2016

(86) PCT No.: PCT/JP2016/001845
§ 371 (c)(1),
(2) Date: Sep. 28, 2017

(87) PCT Pub. No.: WO2016/157901
PCT Pub. Date: Oct. 6, 2016

(65) Prior Publication Data

US 2018/0111377 A1 Apr. 26, 2018

(30) Foreign Application Priority Data

Mar. 31, 2015 (JP) ..... 2015-070897

(51) Int. Cl.
*B41J 2/175* (2006.01)
*B41J 29/02* (2006.01)
*B41J 29/13* (2006.01)

(52) U.S. Cl.
CPC ..... *B41J 2/175* (2013.01); *B41J 2/1752* (2013.01); *B41J 2/17509* (2013.01);
(Continued)

(58) Field of Classification Search
CPC .... B41J 2/175; B41J 2/17503; B41J 2/17506; B41J 2/17509; B41J 2/1752;
(Continued)

(56) References Cited

U.S. PATENT DOCUMENTS 4,476,472 A * 10/1984 Aiba ..... B41J 2/17503 347/86
4,636,814 A * 1/1987 Terasawa ..... B41J 2/17566 347/7

(Continued)

FOREIGN PATENT DOCUMENTS

CN 201317161 Y 9/2009
CN 103448372 A 12/2013

(Continued)

OTHER PUBLICATIONS

International Search Report and Japanese Language Written Opinion received in International Application No. PCT/JP2016/001845 dated Jun. 21, 2016.

*Primary Examiner* — Anh T.N. Vo
(74) *Attorney, Agent, or Firm* — Foley & Lardner LLP

(57) ABSTRACT

There is provided a technique that enhances the detection accuracy of a liquid contained in a tank unit. A printer 10 is provided with a tank unit 40A. The tank unit 40A includes a plurality of ink tanks 43A and a plurality of ink cylinder portions 46A. Each of the plurality of ink cylinder portions 46A is connected with corresponding one of the ink tanks 43A by a tube 47, such as to cause ink contained in the corresponding ink tank 43A to flow into the ink cylinder portion 46A. Each of the ink cylinder portions 46A is provided with a pair of terminal pins 96*a* and 96*b* that are used for detection of ink. A horizontal sectional area of the ink cylinder portion 46A at a height position where the pair of terminal pins 96*a* and 96*b* are provided is smaller than a horizontal sectional area of the ink tank 43A at a corresponding height position.

11 Claims, 21 Drawing Sheets

(52) U.S. Cl.
CPC ..... *B41J 2/17513* (2013.01); *B41J 2/17523* (2013.01); *B41J 2/17553* (2013.01); *B41J 2/17566* (2013.01); *B41J 29/02* (2013.01); *B41J 29/13* (2013.01); *B41J 2002/17573* (2013.01); *B41J 2002/17579* (2013.01)

(58) Field of Classification Search
CPC ..... B41J 2/17513; B41J 2/17523; B41J 2/47553; B41J 2/17566; B41J 2/17573
See application file for complete search history.

(56) References Cited

U.S. PATENT DOCUMENTS 5,689,290 A 11/1997 Saito et al.
5,775,164 A 7/1998 Kishi
6,007,193 A * 12/1999 Kashimura ..... B41J 2/1707 347/18
6,267,474 B1 * 7/2001 Mochizuki ..... B41J 2/175 347/85
6,293,662 B1 * 9/2001 Shihoh ..... B41J 2/175 347/49
7,066,585 B2 * 6/2006 Kumagai ..... B41J 2/17509 347/85
7,399,075 B2 * 7/2008 Nomura ..... B41J 2/17503 347/89
2005/0151802 A1 * 7/2005 Neese ..... B41J 2/17513 347/85
2013/0321534 A1 12/2013 Ishizawa et al.
2015/0130879 A1 * 5/2015 Kimura ..... B41J 2/17506 347/85

FOREIGN PATENT DOCUMENTS

JP H09-145451 A 6/1997
JP 2007-237552 A 9/2007
JP 2011-056741 A 3/2011

* cited by examiner

LIQUID SUPPLY APPARATUS AND LIQUID CONSUMING APPARATUS

CROSS REFERENCE TO RELATED APPLICATIONS

This application is a national stage entry of PCT/JP2016/001845, filed Mar. 30, 2016; which claims priority to Japanese Application No. 2015-070897, filed Mar. 31, 2015; the disclosures of which are herein incorporated by reference in their entirety.

FIELD

The present disclosure relates to a liquid supply apparatus and a liquid consuming apparatus.

BACKGROUND

An inkjet printer that forms an image by ejection of ink, hereinafter may be simply referred to as "printer", is known as one aspect of the liquid consuming apparatus. The printer is generally provided with a tank unit that is one aspect of the liquid supply apparatus and receives supply of ink from an ink tank included in the tank unit. A technique of providing a detector configured to detect the remaining amount of ink in the ink tank has been proposed with regard to the printer (for example, Patent Literature 1 given below).

CITATION LIST

Patent Literature

PTL 1: JP 1109-145451A

SUMMARY

Technical Problem

The technique of Patent Literature 1 applies electric current to a pair of electrodes placed in the tank and detects the remaining amount of ink based on a change in the resistance. With regard to the technique of Patent Literature 1, however, when the tank is placed to be inclined relative to a generally expected layout angle, the position of a liquid level of ink in the tank is likely to be changed. This makes it likely to decrease the detection accuracy of ink contained in the tank.

In the printer, it is desirable to enhance the detection accuracy of ink by the detector, in order to suppress, for example, a printing failure or deterioration of a print head due to out of ink or the like. It is also desirable to suppress a decrease in the detection accuracy of ink and suppress size expansion of the detector even when a large-sized ink tank is provided to increase the capacity of ink in the ink tank. Additionally, it is desirable to readily check the remaining amount of ink in the ink tank with or without using the detector. Furthermore, with regard to the printer and the tank unit included in the printer, there are other conventional needs including for example, downsizing, cost reduction, resource saving, easy manufacture, and improvement of usability.

Solution to Problem

The present disclosure may be implemented by aspects described below, in order to solve at least part of the above problems with regard to a liquid supply apparatus that is configured to supply a liquid to a liquid consuming apparatus.

[1] According to a first aspect of the present disclosure, there is provided a liquid supply apparatus. This liquid supply apparatus may comprise a first liquid container, a second liquid container and a detector. The first liquid container may be provided to contain the liquid and may be configured to introduce the air into the first liquid container. The second liquid container may be provided to contain the liquid and may be configured to communicate with the first liquid container so that the liquid in the first liquid container flows into the second liquid container and to introduce the air into the second liquid container. The detector may be configured to detect the liquid contained in the second liquid container. A sectional area of a horizontal section of the second liquid container at a detecting position where the detector detects the liquid may be smaller than a sectional area of a horizontal section of the first liquid container at a height position corresponding to the detecting position. The liquid supply apparatus of this aspect reduces the effect of a variation in layout angle of the liquid supply apparatus on the detection accuracy of the liquid and thereby enhances the detection accuracy of the liquid.

[2] In the liquid supply apparatus of the above aspect, the detecting position may be located on a lower edge side that is nearer to a lower edge than an upper edge of the second liquid container in direction of gravity. The detector may detect presence or absence of the liquid at the detecting position. The liquid supply apparatus of this aspect enhances the detection accuracy of the remaining amount of the liquid in the tank.

[3] In the liquid supply apparatus of the above aspect, the second liquid container may include a visible portion that is configured to cause a user to visually recognize position of a liquid level of the liquid from outside. The liquid supply apparatus of this aspect enables the user to visually check the amount of the liquid contained in the first liquid container via the second liquid container.

[4] In the liquid supply apparatus of the above aspect, an air flow passage may be provided between the second liquid container and the first liquid container so that the air flows between the second liquid container and the first liquid container. The liquid supply apparatus of this aspect causes the internal atmospheric state to be shared by the first liquid container and the second liquid container and thereby enhances the accuracy of detection via the second liquid container, with regard to the amount of the liquid contained in the first liquid container. This configuration also does not require to provide a structure inside of the second liquid container for the purpose of suppressing vaporization of the liquid. This configuration accordingly suppresses size expansion of the second liquid container by providing such a structure.

[5] In the liquid supply apparatus of the above aspect, the first liquid container may include a liquid chamber configured to contain the liquid, and an air chamber configured to communicate with the liquid chamber and to contain the air. The air flow passage may be connected with the air chamber. The liquid supply apparatus of this aspect enables the air contained in the air chamber of the first liquid container to be introduced into the second liquid container.

[6] In the liquid supply apparatus of the above aspect, the second liquid container may include a liquid chamber configured to contain the liquid, an air release port configured to be open toward outside, and an air communication passage extended from the air release port toward the liquid chamber and configured to flow the air to be introduced into the liquid chamber. In the liquid supply apparatus of this aspect, the second liquid container includes the air communication passage. This configuration suppresses leakage and vaporization of the liquid from the second liquid container via the air release port.

[7] In the liquid supply apparatus of the above aspect, the second liquid container may include a liquid filling portion having a fill port configured to accept the liquid to be injected from outside. The liquid supply apparatus of this aspect allows the user to supply the liquid via the second liquid container having the visible portion. This configuration enhances the user's convenience.

[8] In the liquid supply apparatus of the above aspect, the second liquid container may include a seal member configured to seal the fill port of the liquid filling portion. The liquid supply apparatus of this aspect suppresses leakage and vaporization of the liquid from the second liquid container via the fill port and also suppresses extraneous substances from entering the second liquid container.

[9] The liquid supply apparatus of the above aspect may comprise multiple sets of the first liquid container and the second liquid container in pair. A first liquid container array may be configured by a plurality of the first liquid containers arranged in a line in a first direction, and a second liquid container array may be configured by a plurality of the second liquid containers arranged in a line in a second direction that intersects with the first direction. In the liquid supply apparatus of this aspect, the first liquid containers and the second liquid containers are respectively arranged collectively. This configuration enhances the user's convenience. The collective arrangement of the second liquid containers allows for downsizing of the detector.

[10] In the liquid supply apparatus of the above aspect, the second liquid container array may be placed at a position adjoining to the first liquid container array in the first direction. A width of the second liquid container array in the second direction may be smaller than a width of the first liquid container array in the second direction. The liquid supply apparatus of this aspect enables the first liquid container array and the second liquid container array to be arranged collectively and compactly and thereby allows for downsizing of the apparatus.

[11] In the liquid supply apparatus of the above aspect, the detector may include a detection element placed inside of the second liquid container and a connecting assembly placed outside of the second liquid container and configured to transmit a signal to and from the detection element. The connecting assembly may be placed between the first liquid container array and the second liquid container array. The liquid supply apparatus of this aspect enables the space between the first liquid container array and the second liquid container array to be effectively used and thereby allows for downsizing of the apparatus.

[12] According to a second aspect of the present disclosure, there is provided a liquid consuming apparatus. This liquid consuming apparatus may comprise a liquid supply apparatus and a liquid consuming portion. This liquid supply apparatus may be the liquid supply apparatus of any of the above aspects. The liquid consuming portion may be configured to consume the liquid that is supplied from the liquid supply apparatus. The liquid consuming apparatus of this aspect enhances the detection accuracy of the liquid in the liquid supply apparatus and thereby enhances the management performance of the liquid that is to be consumed.

[13] In the liquid consuming apparatus of the above aspect, the second liquid container may be placed on a front face side of the liquid consuming apparatus. The liquid consuming apparatus of this aspect enhances the user's accessibility to the second liquid container.

All the plurality of components included in each of the aspects of the disclosure described above are not essential, but some components among the plurality of components may be appropriately changed, omitted or replaced with other additional components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the disclosure described above may be combined with part or all of the technical features included in another aspect of the disclosure described above to provide one independent aspect of the disclosure.

The present disclosure may be implemented by various aspects other than the liquid supply apparatus and the liquid consuming apparatus. For example, the present disclosure may be implemented by a liquid container, a liquid container unit, a liquid detection apparatus, a control method of the liquid supply apparatus or the liquid consuming apparatus, a management method of the amount of a liquid in the liquid supply apparatus or in the liquid consuming apparatus, a computer program that implements each of these methods, and a non-transitory recording medium in which such a computer program is recorded. In the description hereof, the term "apparatus" means a set of a plurality of components that are combined integrally or dispersedly in a complex manner such that respective functions of these components are related to each other directly or indirectly, in order to implement one or more functions. Accordingly, the aspects of the "apparatus" in the description hereof include an aspect that the plurality of components are combined integrally and an aspect that some parts of the plurality of components or the respective components are arranged dispersedly in a plurality of locations.

DESCRIPTION OF EMBODIMENTS

A. First Embodiment

[Schematic Configuration of Printer]

Figure 1:
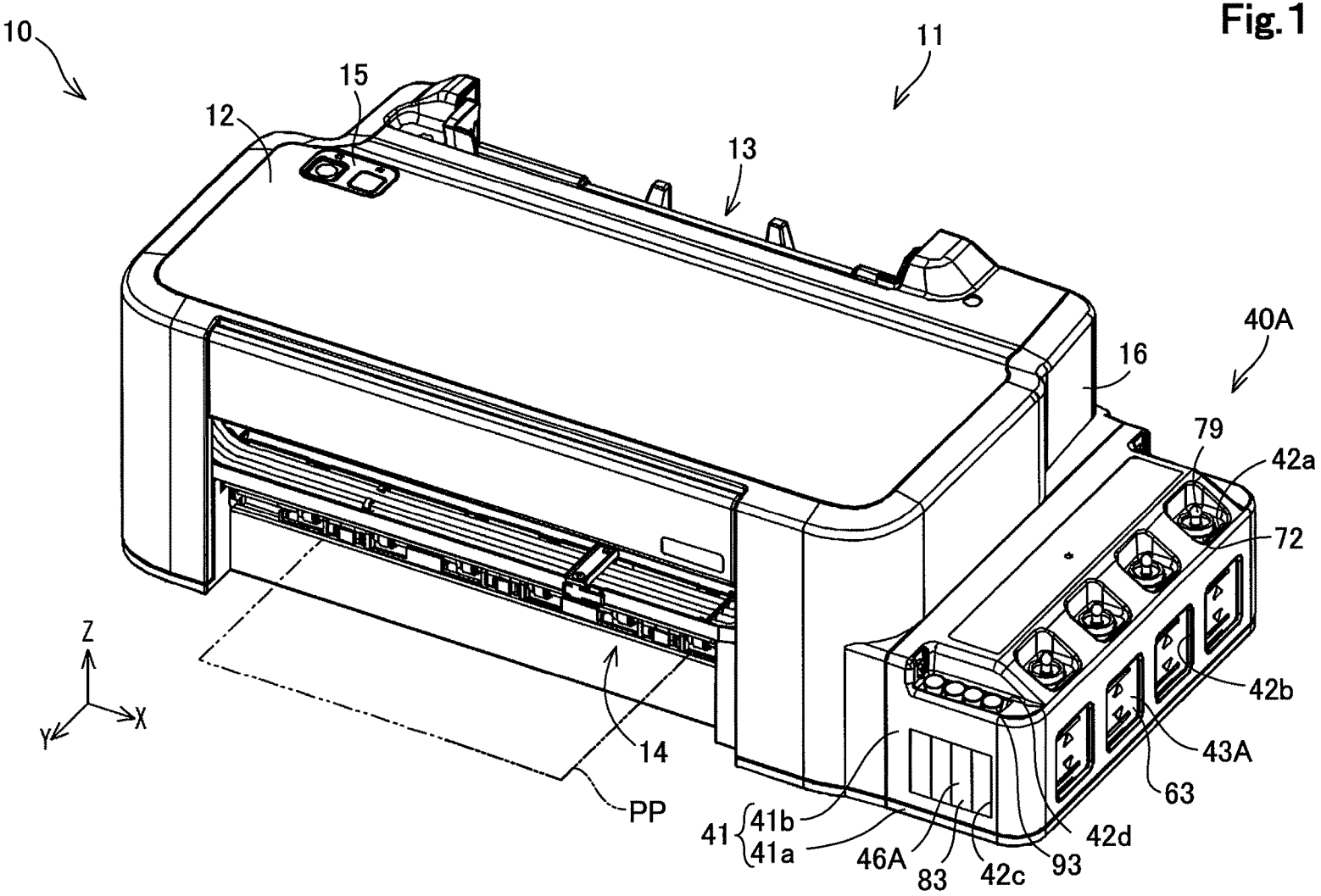
FIG. 1 is a schematic perspective view illustrating the appearance configuration of a printer according to a first embodiment.
Figure 2:
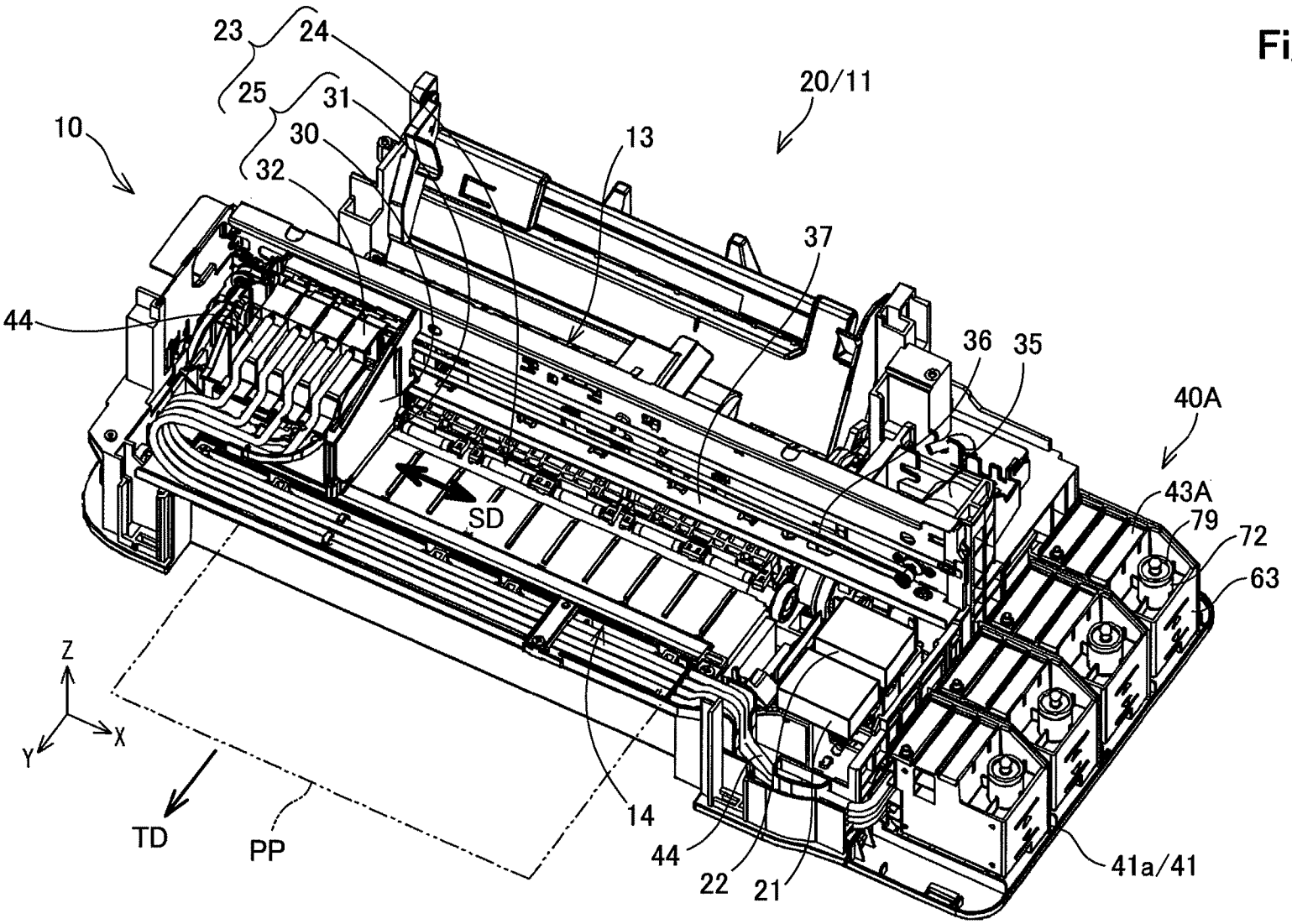
FIG. 2 is a schematic perspective view illustrating an internal unit of the printer according to the first embodiment.
Figure 3:
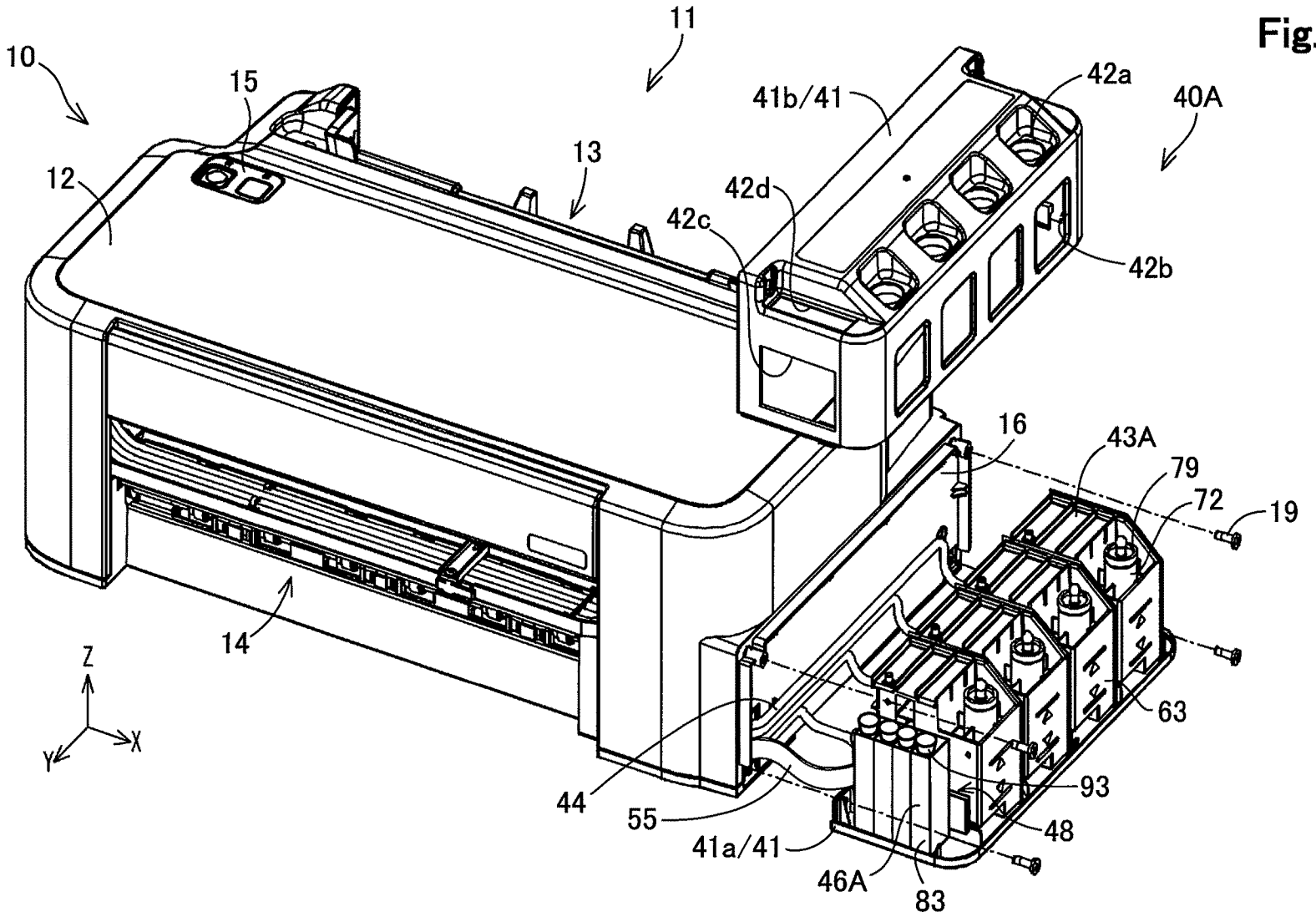
FIG. 3 is a schematic exploded perspective view illustrating the printer according to the first embodiment.

The configuration of an inkjet printer 10, hereinafter simply called "printer 10", according to a first embodiment of the present disclosure is described with reference to FIGS. 1 to 3. FIG. 1 is a schematic perspective view illustrating the appearance configuration of the printer 10. FIG. 2 is a schematic perspective view illustrating an internal unit 20 of the printer 10. FIG. 2 illustrates the state that the internal unit 20 of the printer 10 is exposed by detachment of a casing portion 12 and a box body portion 41*b* from the printer 10. As a matter of convenience, an indicator assembly 45 is omitted from the illustration of FIG. 2. FIG. 3 is a schematic exploded perspective view illustrating the printer 10 in a partly exploded state. FIG. 3 illustrates the state that a tank unit 40A is separated from a printing unit 11 and that a casing portion 41 is removed from the tank unit 40A.

Arrows X, Y and Z are illustrated in FIGS. 1 to 3 with respect to the printer 10. The arrows X, Y and Z indicate three directions that are orthogonal to one another. The arrow X indicates a left-right direction that is parallel to a lateral direction, i.e. width direction, of the printer 10 and shows a direction from the left side toward the right side when the user faces the printer 10. The arrow Y indicates a direction parallel to a front-rear direction of the printer 10 and shows a direction from the rear side that is rear face side, toward the front side that is front face side. In the description hereof, the front side or the front face side of the printer 10 denotes a surface side which many users are expected to face for operation of the printer 10 during normal printing. The arrow Z indicates a height direction of the printer 10 and shows a vertically upward direction relative to a mounting plane on which the printer 10 is mounted. In the ordinary use of the printer 10, the arrows X and Y indicate directions parallel to a horizontal plane, and the arrow Z indicates an opposite direction to the direction of gravity (vertical direction). In the other drawings used for explanation in the description hereof, arrows X, Y and Z are illustrated corresponding to those in FIGS. 1 to 3. In the description hereof, the "upper" or "lower" means a direction relative to the direction of the arrow Z. Similarly, the "front" or "rear" means a direction relative to the direction of the arrow Y. The "left" or "right" means a direction relative to the direction of the arrow X.

The printer 10 corresponds to one embodiment of the liquid consuming apparatus of the present disclosure. The printer 10 is configured to eject ink droplets on a printing paper PP as a printing medium according to print data supplied from outside and thereby form an image. The printing paper PP is shown by a two-dot chain line in FIGS. 1 and 3 as a matter of convenience. The printer 10 includes a printing unit 11 and a tank unit 40 as shown in FIG. 1. The printing unit 11 corresponds to a subordinate concept of the liquid consuming portion of the present disclosure and is configured to form a printed image by ejecting ink onto the printing paper PP. The tank unit 40A corresponds to a subordinate concept of the liquid supply apparatus of the present disclosure and is configured to supply ink to the printing unit 11.

According to this embodiment, the printing unit 11 and the tank unit 40A are configured as separate bodies. This configuration enables the printing unit 11 and the tank unit 40A to be separately subjected to maintenance and enhances the maintenance performance of the printer 10. In the ordinary use, the printing unit 11 and the tank unit 40A are coupled with each other as described later in detail. This configuration enables the printing unit 11 and the tank unit 40A to be collectively carried and facilitates the transfer and installation of the printer 10. The following first describes the configuration of the printing unit 11 and subsequently describes the configuration of the tank unit 40A and the like.

[Configuration of Printing Unit]

The printing unit 11 includes a casing portion 12 and an internal unit 20. The casing portion 12 is configured as a hollow box body in an approximately rectangular parallelepiped shape as shown in FIG. 1 and includes the internal unit 20 placed therein as shown in FIG. 2. A paper feed slot 13 is provided on a rear face side of the printing unit 11 to feed the printing paper PP into the internal unit 20 as shown in FIG. 1. A paper ejection slot 14 is provided on a front face side thereof to eject the printing paper PP fed from the internal unit 20. An interface portion 15 is provided on a top surface portion of the casing portion 41 that faces upward. The interface portion 15 includes operation switches used for entries of the user's operations, for example, a power button and a button operates to give an instruction to start a printing process.

The internal unit 20 shown in FIG. 2 includes a controller 21, a signal processor 22 and an image forming unit 23. The controller 21 is configured by a microcomputer including a central processing unit and a main memory unit. The controller 21 controls the respective components of the printing unit 11 to perform a printing process, in response to the user's operation via the interface portion 15 or a command from an external computer. The controller 21 also controls the signal processor 22 to perform a management process with regard to the amounts of inks in the tank unit 40A. The signal processor 22 is a circuit unit configured to generate electric signals for detection of inks and send and receive electric signals. The management process with regard to the amounts of inks by the controller 21 will be described later.

The image forming unit 23 is configured to convey the printing paper PP and form an image on the printing paper PP under control of the controller 21. The image forming unit 23 includes a paper conveying mechanism 24 and a print head unit 25. The paper conveying mechanism 24 is configured to convey the printing paper PP fed from the paper feed slot 13 to the paper ejection slot 14 by rotating and driving of a conveying roller.

The print head unit 25 is provided on a conveyance path of the printing paper PP and is configured to eject ink supplied from the tank unit 40A while moving back and forth in a main scanning direction SD in the printing process. According to this embodiment, the main scanning direction SD is a direction perpendicular to a sub-scanning direction TD that is a conveyance direction of the printing paper PP by the paper conveying mechanism 24 and is a direction parallel to the direction of the arrow X. The print head unit 25 corresponds to a subordinate concept of the liquid consuming portion of the present disclosure.

The print head unit 25 includes a carriage 30, an ink ejection head 31 and a plurality of relay units 32. A rotational driving force of a motor 35 is transmitted by an endless belt 36, so that the carriage 30 moves back and forth along a guide rail 37 extended in the direction of the arrow X that is the main scanning direction SD.

The ink ejection head 31 is provided on a lower face of the carriage 30 and is conveyed by the carriage 30. The ink ejection head 31 includes a plurality of nozzles that are provided on a surface to be opposed to the printing paper PP to eject ink droplets, and is configured to eject ink droplets toward a printing surface of the printing paper PP that is conveyed by the paper conveying mechanism 24, under control of the controller 21.

Each of the relay units 32 is placed above the ink ejection head 31 and is connected with corresponding one of a plurality of ink tanks 43A via a tube 44. Each of the relay units 32 includes a suction pump and is configured to suck ink from a corresponding ink tank 43A via the tube 44 and supply the sucked ink to the ink ejection head 31.

[Configuration of Tank Unit]

Figure 4:
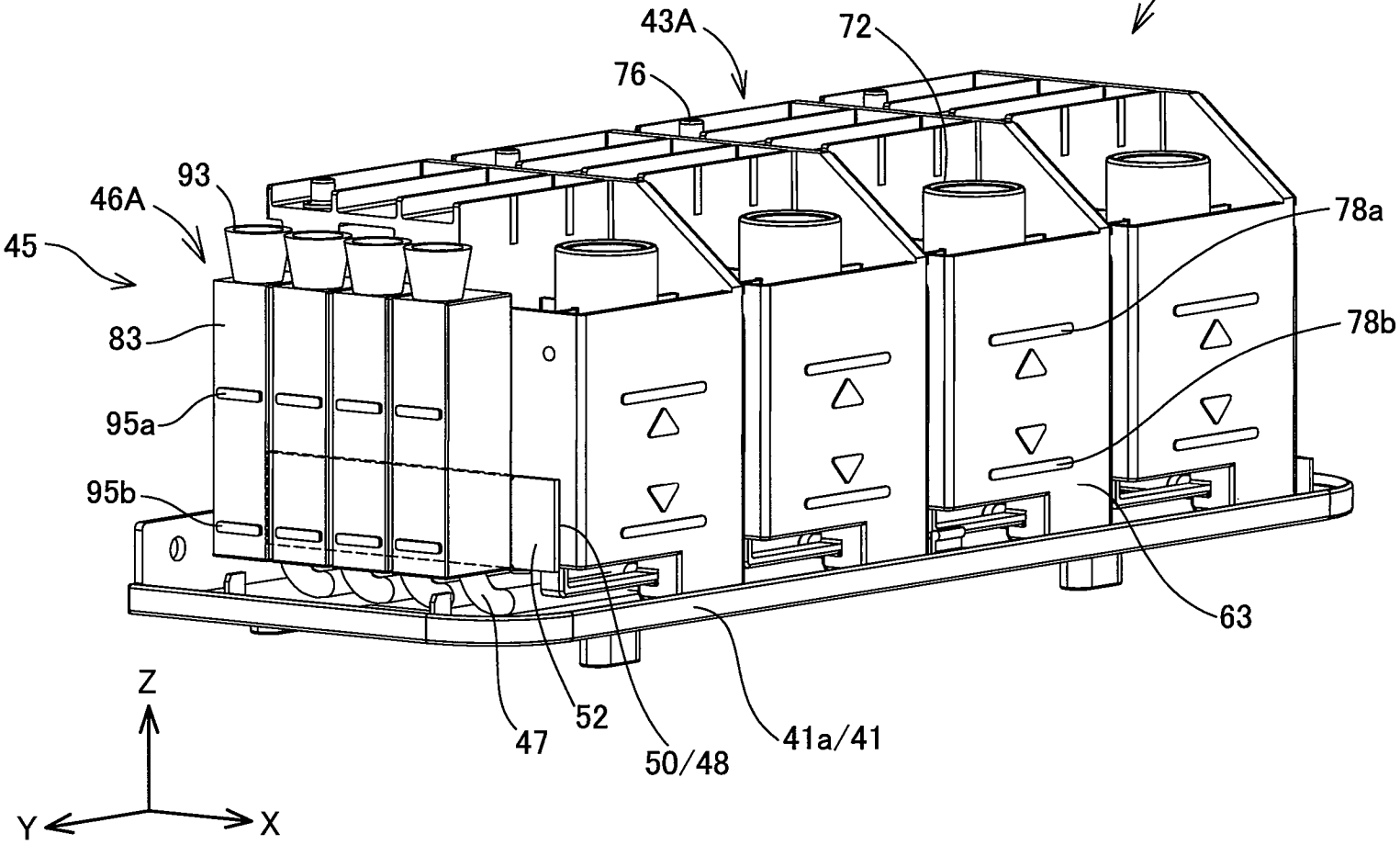
FIG. 4 is a front face-side schematic perspective view illustrating a tank unit according to the first embodiment.
Figure 5:
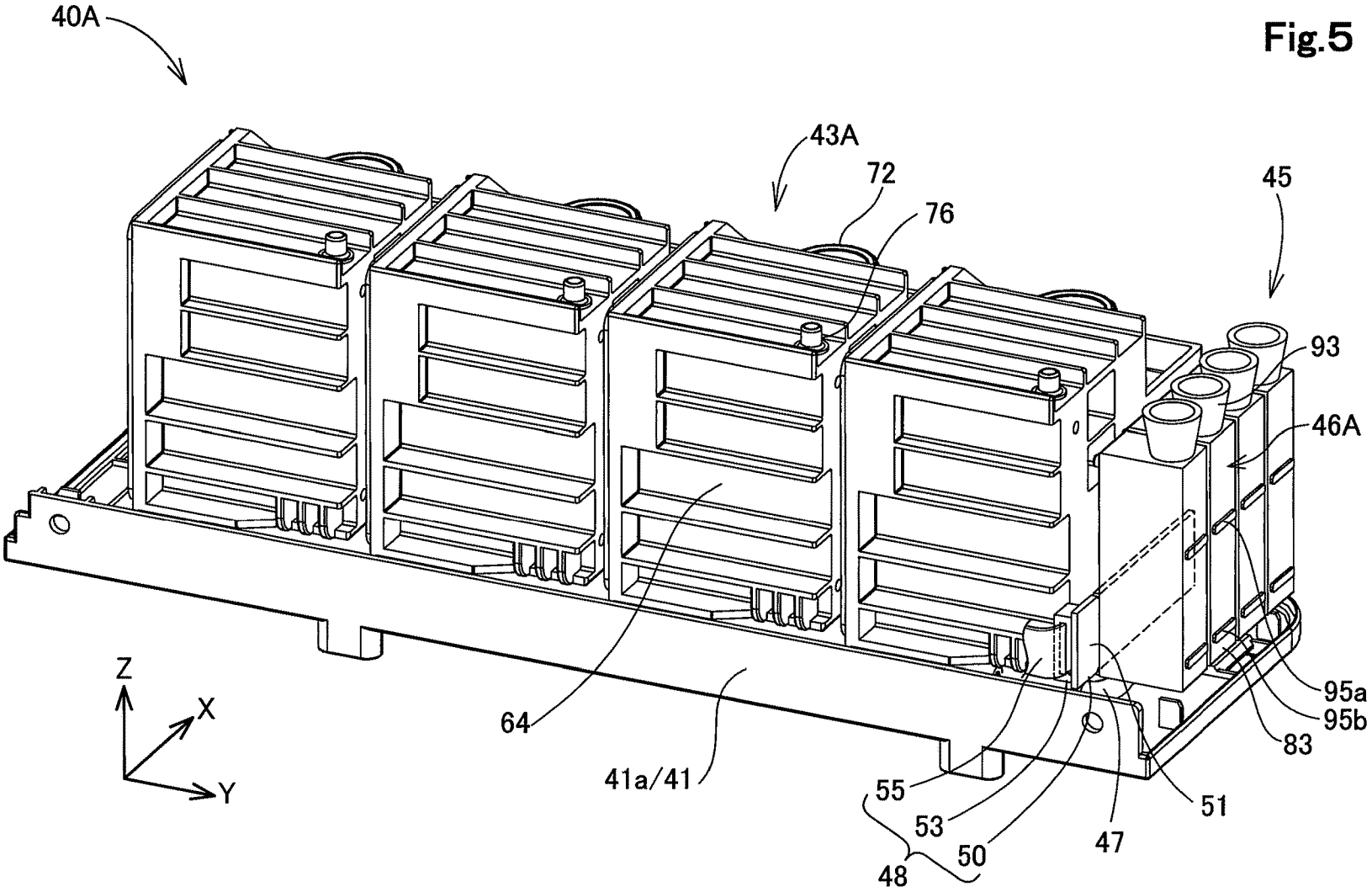
FIG. 5 is a rear face-side schematic perspective view illustrating the tank unit according to the first embodiment.

The configuration of the tank unit 40A is described with reference to FIGS. 4 and 5, in addition to FIGS. 1 to 3. FIG. 4 is a front face-side schematic perspective view illustrating a front face side of the tank unit 40A with removal of the casing portion 41. FIG. 5 is a rear face-side schematic perspective view illustrating a rear face side of the tank unit 40A with removal of the casing portion 41. Arrows X, Y and Z corresponding to those in FIGS. 1 to 3 are illustrated in FIGS. 4 and 5 with respect to the tank unit 40A in the state that is coupled with the printer 10.

The tank unit 40A is fixed to a left side surface portion 16 of the casing portion 12 of the printing unit 11 as shown in FIG. 1. According to this embodiment, the width of the tank unit 40A in the direction of the arrow Y is approximately equal to the width of the side surface portion 16 of the printer 10 in the direction of the arrow Y. According to this embodiment, the tank unit 40A is screwed to the casing portion 12 of the printing unit 11 by means of a plurality of screws 19 as shown in FIG. 3. In the state that the tank unit 40A is coupled with the printer 10, a side of the tank unit 40A facing the printing unit 11 denotes a rear face side, and a side facing opposite to the printing unit 11 denotes a front face side. In other words, the side facing an opposite direction to the direction of the arrow X denotes the rear face side, and the side facing the direction of the arrow X denotes the front face side.

The tank unit 40A includes a casing portion 41, a plurality of ink tanks 43A, a plurality of tubes 44 and an indicator assembly 45 as shown in FIGS. 1 and 3. The casing portion 41 is comprised of a bottom plate portion 41*a* and a box body portion 41*b* as shown in FIG. 3. The bottom plate portion 41*a* is a plate-shaped member in an approximately rectangular shape provided to form a bottom surface portion of the tank unit 40A. The box body portion 41*b* is a member that is located above the bottom plate portion 41*a* and that is configured as a hollow body in an approximately rectangular parallelepiped shape with an entire lower side open. The respective ink tanks 43A and the indicator assembly 45 are placed inside of the casing portion 41.

The box body portion 41*b* of the casing portion 41 is provided with a plurality of first windows 42*a* and a plurality of second windows 42*b* that are openings configured to expose parts of the ink tanks 43A to the outside as shown in FIG. 1. Each ink tank 43A is provided with one first window 42*a* and one second window 42*b*. The casing portion 41 is also provided with one third window 42*c* and one fourth window 42*d* that are openings configured to expose parts of the indicator assembly 45 to the outside. The details of the four different windows 42*a* to 42*d* provided in the casing portion 41 will be described later.

The plurality of ink tanks 43A are containers configured to contain inks and correspond to a subordinate concept of the first liquid containing portion of the present disclosure as shown in FIGS. 3 to 5. Different color inks are contained in the respective ink tanks 43A. According to this embodiment, the tank unit 40A includes four ink tanks 43A that respectively contain cyan, magenta, yellow and black inks. In the tank unit 40A of this embodiment, the respective ink tanks 43A are aligned in the direction of the arrow Y. The direction of the arrow Y according to this embodiment corresponds to the first direction of the present disclosure. One resin tube 44 having flexibility is connected with each of the ink tanks 43A as shown in FIG. 3. The ink contained in each of the ink tanks 43A is supplied through the tube 44 to corresponding one of the plurality of relay units 32 included in the print head unit 25 of the printing unit 11 as shown in FIG. 2. The details of the configuration of the ink tank 43A will be described later.

The indicator assembly 45 is provided on the front face side of the printer 10 and on an end in the direction of the arrow Y in the tank unit 40A as shown in FIG. 3. The indicator assembly 45 includes a plurality of ink cylinder portions 46A, a plurality of tubes 47 and a terminal connecting assembly 48 as shown in FIGS. 3 to 5. Each of the plurality of ink cylinder portions 46A is provided corresponding to each of the ink tanks 43A. According to this embodiment, the indicator assembly 45 includes four ink cylinder portions 46A corresponding to the four ink tanks 43A.

The respective ink cylinder portions 46A are configured by hollow containers in an approximately rectangular parallelepiped shape to contain the respective inks therein and are aligned in the direction of the arrow X. Each of the ink cylinder portions 46A is connected with corresponding one of the plurality of ink tanks 43A by means of the tube 47 such that the ink flows from the corresponding ink tank 43A into the ink cylinder portion 46A as shown in FIG. 4. The ink cylinder portion 46A corresponds to a subordinate concept of the second liquid containing portion of the present disclosure. The direction of the arrow X in which the ink cylinder portions 46A are aligned corresponds to the second direction of the present disclosure. The position of a liquid level of ink in each of the ink cylinder portions 46A indicates the amount of ink contained in the corresponding ink tank 43A. Each of the ink cylinder portions 46A is configured such that the position of the liquid level is visible from the outside. The details of the configuration of the ink cylinder portion 46A will be described later.

In the tank unit 40A, the terminal connecting assembly 48 is provided in a gap between the respective ink cylinder portions 46A and the ink tank 43A as shown in FIGS. 3 to 5. A pair of terminal pins are mounted to each of the ink cylinder portions 46A to be used for detection of ink contained in the ink cylinder portion 46A as described later. The terminal connecting assembly 48 is electrically connected with the pair of terminal pins in each of the ink cylinder portions 46A. The terminal connecting assembly 48 includes a substrate portion 50, a cable connecting portion 53 and a wiring cable 55.

The substrate portion 50 is configured by a printed circuit board in an approximately rectangular shape as shown in FIGS. 4 and 5. The substrate portion 50 may be configured by a flexible printed circuit board having flexibility. The substrate portion 50 is arranged such that a first substrate surface 51 is opposed to the respective ink cylinder portions 46A and that a direction along its longitudinal side is aligned with the direction of the arrow X. According to this embodiment, the substrate portion 50 is located on a lower edge side that is nearer to a lower edge than an upper edge of the ink cylinder portions 46A. The first substrate surface 51 of the substrate portion 50 is provided with a plurality of terminals that electrically come into contact with the terminal pins of the respective ink cylinder portions 46A.

The cable connecting portion 53 is provided on a second substrate surface 52 that is on the opposite side to the first substrate surface 51 of the substrate portion 50. The cable connecting portion 53 is fixed to an end of the substrate portion 50 in the opposite direction to the direction of the arrow X. The cable connecting portion 53 is electrically connected with the terminals that are electrically connected with the respective ink cylinder portions 46A, via a wiring pattern formed on the substrate portion 50. The illustration and the detailed description of the wiring pattern are omitted.

The wiring cable 55 is connected with the cable connecting portion 53. The wiring cable 55 has flexibility, is provided to be extended from the casing portion 41 of the tank unit 40A as shown in FIG. 3 and is connected with the signal processor 22 of the printing unit 11 shown in FIG. 2. Electric current is applied for detection of ink by the signal processor 22 via the terminal connecting assembly 48 to the terminal pins of the respective ink cylinder portions 46A as described later in detail.

[Configuration of Ink Tank]

Figure 6:
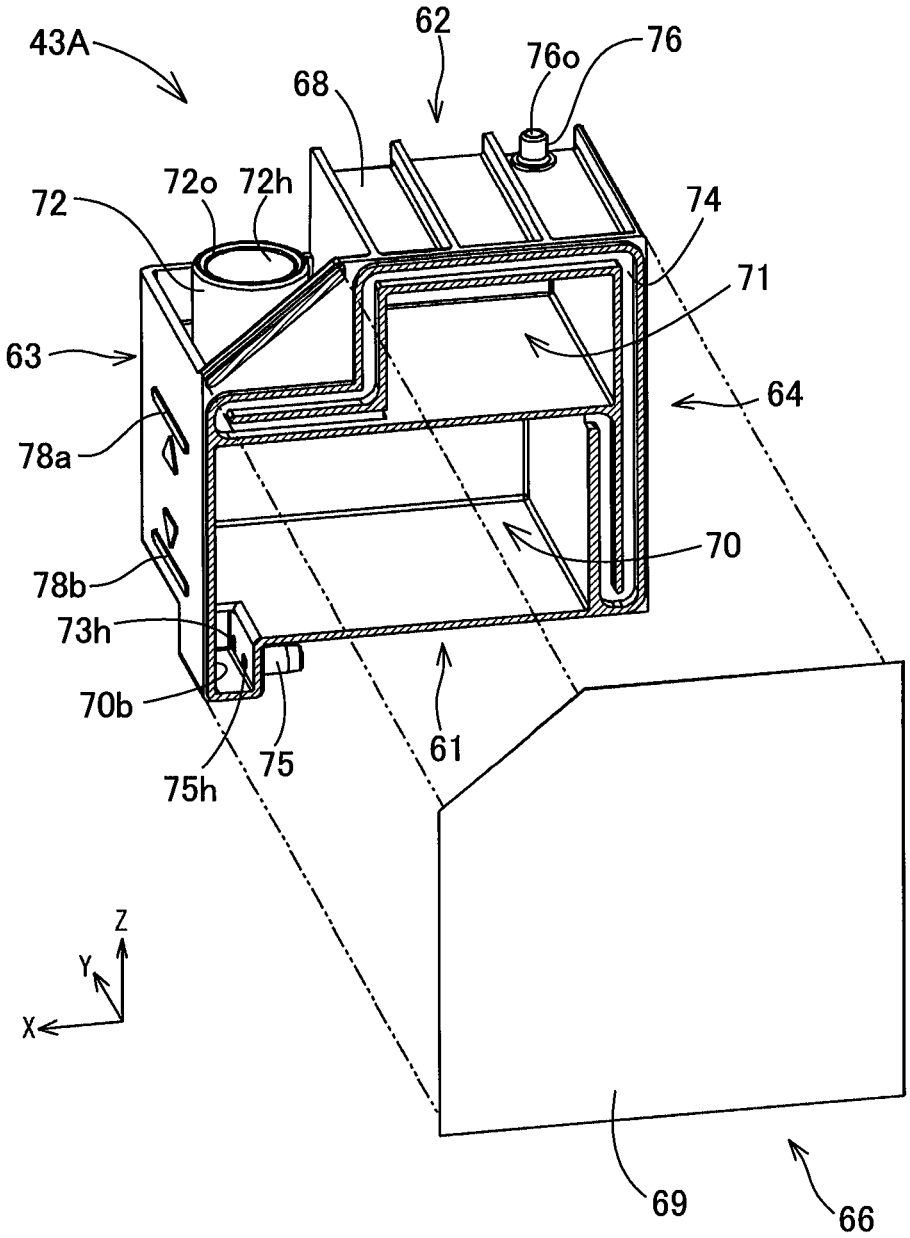
FIG. 6 is a schematic exploded perspective view illustrating an ink tank according to the first embodiment.
Figure 7:
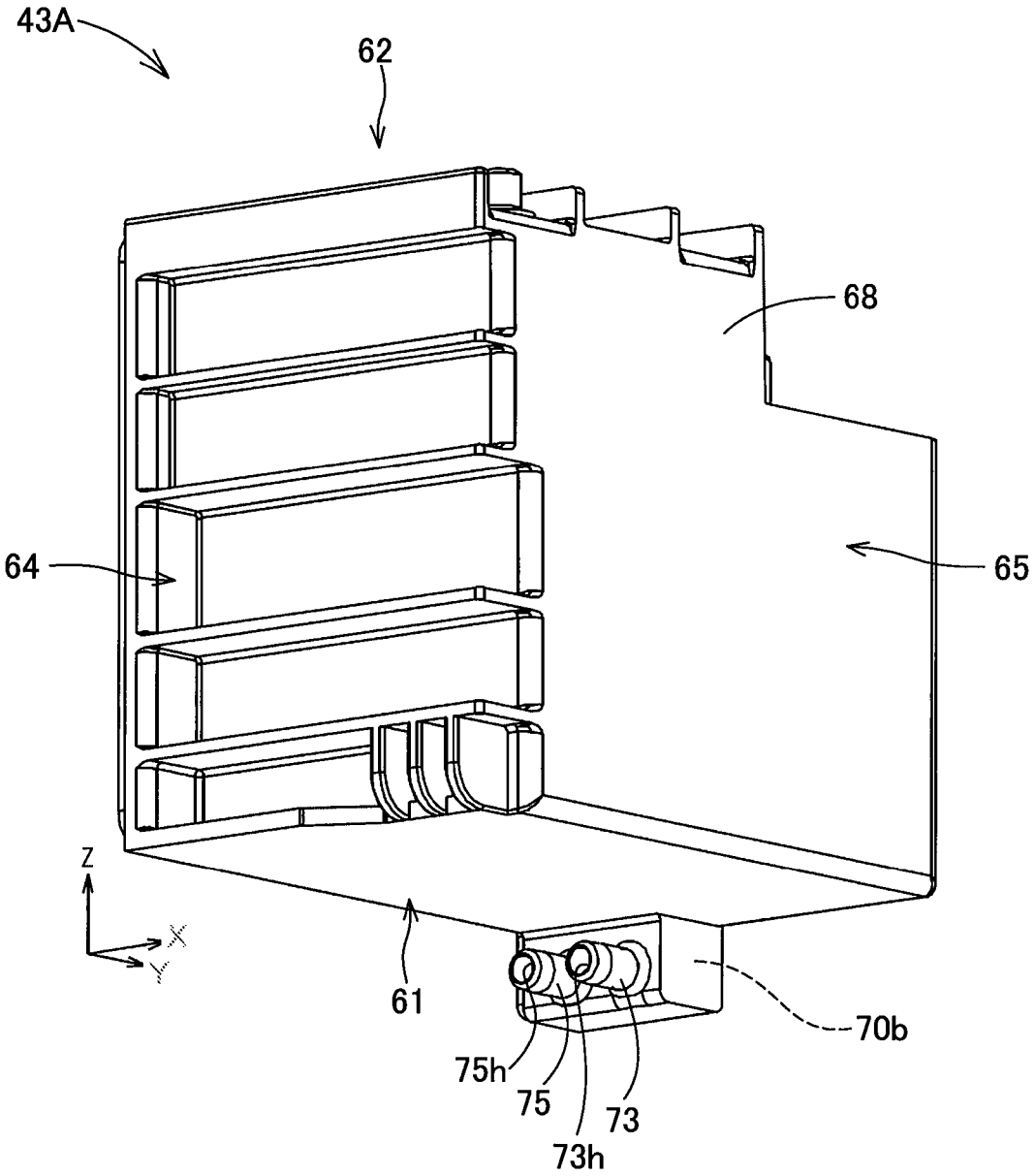
FIG. 7 is a schematic perspective view illustrating the ink tank according to the first embodiment.
Figure 8:
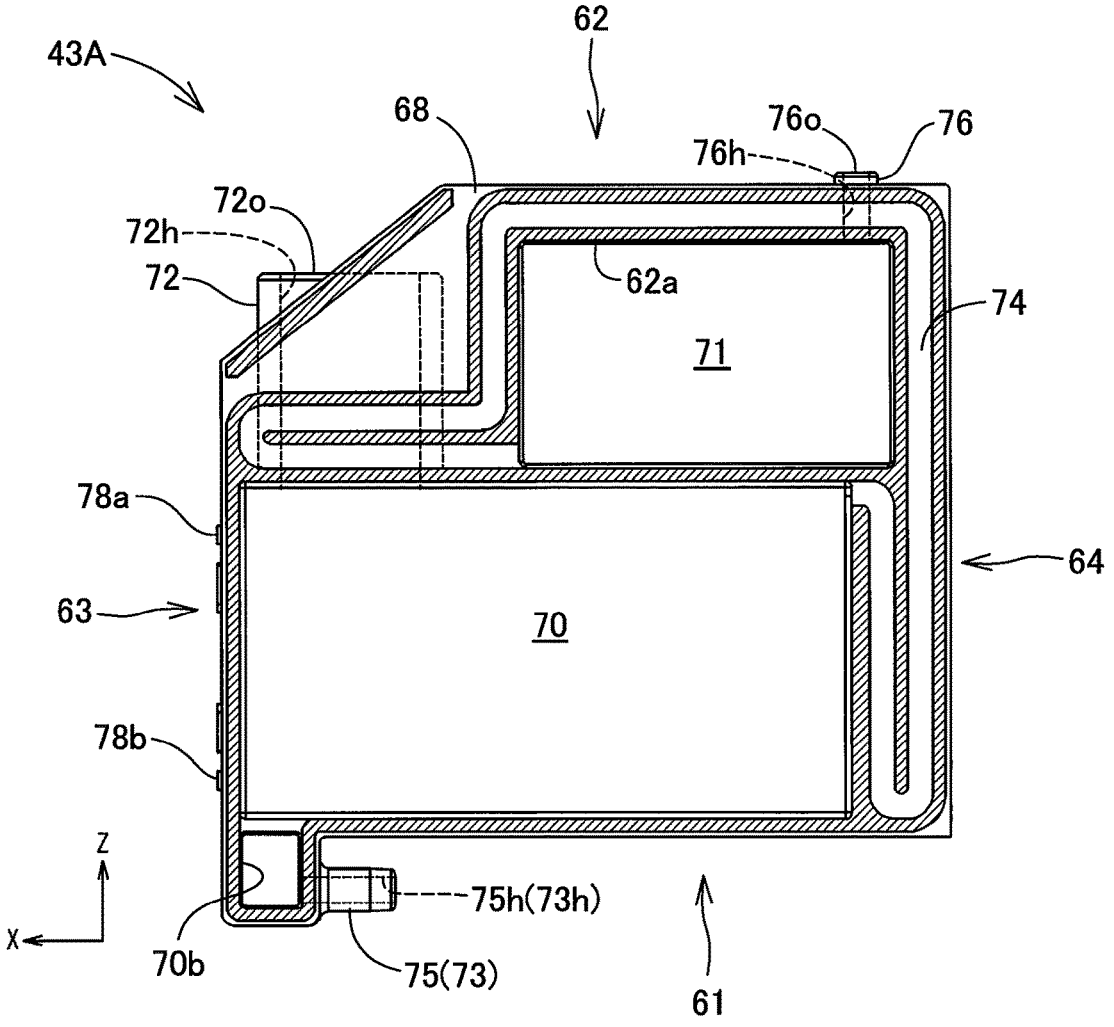
FIG. 8 is a schematic sectional view illustrating the internal configuration of the ink tank according to the first embodiment.

The configuration of the ink tank 43A is described with reference to mainly FIGS. 6 to 8. FIG. 6 is a schematic exploded perspective view illustrating the ink tank 43A. FIG. 7 is a schematic perspective view illustrating the ink tank 43A viewed obliquely upward. FIG. 8 is a schematic sectional view illustrating the internal configuration of the ink tank 43A. FIG. 8 illustrates a schematic section of the ink tank 43A taken along a joint surface of a film member as a cutting plane. Arrows X, Y and Z corresponding to those in FIGS. 1 to 3 are illustrated in FIGS. 6 to 8 with respect to the ink tank 43A in the attitude that is fixed to the tank unit 40A coupled with the printer 10. The directions in the description below are those with respect to the ink tank 43A in the above attitude unless otherwise specified.

The ink tank 43A is configured as a hollow container including six surface portions 61 to 66 as shown in FIGS. 6 and 7. A first surface portion 61 shown in FIG. 7 forms a bottom surface portion that faces downward, and a second surface portion 62 shown in FIG. 6 forms a top surface portion that faces upward. A third surface portion 63 shown in FIG. 6 intersects with the first surface portion 61 and the second surface portion 62 and forms a front surface portion that faces the front face side of the tank unit 40A. A fourth surface portion 64 shown in FIG. 7 intersects with the first surface portion 61 and the second surface portion 62 and forms a rear surface portion that faces in an opposite direction to the third surface portion 63. A fifth surface portion 65 shown in FIG. 7 intersects with all the four surface portions 61 to 64 described above and forms a left side surface portion that is located on the left side when the user faces the third surface portion 63. A sixth surface portion 66 shown in FIG. 6 intersects with all the four surface portions 61 to 64 and forms a right side surface portion that is located on the right side when the user faces the third surface portion 63.

In the description hereof, the "surface portion" means a region that is extended to have a surface facing in a predetermined direction. The "surface portion" may not necessarily be formed in a planar shape but may be formed in a curved shape or may be configured to have a concave, a convex, a step, a groove, a bent portion or an inclined surface. The state that two surface portions "intersect" means any one of the state that two surface portions actually intersect with each other, the state that an extended surface of one surface portion intersects with the other surface portion and the state that extended surfaces of two surface portions intersect with each other. Accordingly a chamfered portion that forms a curved surface or the like may be placed between adjacent surface portions.

The ink tank 43A is comprised of a case member 68 and a film member 69 as shown in FIG. 6. The case member 68 is configured as a hollow box body with an entire surface open on an opposite direction side to the direction of the arrow Y. According to this embodiment, the case member 68 has a width in the direction of the arrow Y that is smaller than the width in the direction of the arrow X. The case member 68 may be produced by, for example, integral molding of a synthetic resin such as nylon or polypropylene. The five surface portions 61 to 65 of the ink tank 43A other than the sixth surface portion 66 are formed by outer wall portions of the case member 68.

The film member 69 is a thin film member having flexibility and is joined with the case member 68 such as to seal the entire opening of the case member 68 on the opposite direction side to the direction of the arrow Y as shown in FIG. 6. The film member 69 forms the sixth surface portion 66 of the ink tank 43A. The film member 69 may be configured by, for example, a sheet member made of a synthetic resin such as nylon or polypropylene. The film member 69 may be joined with the case member 68, for example, by welding. The ink tank 43A of this embodiment is configured easily from the case member 68 and the film member 69 to be light in weight. Like the sixth surface portion 66-side, the fifth surface portion 65-side of the ink tank 43A may also be formed by a film member 69 joined with the case member 68.

An internal space defined between the case member 68 and the film member 69 is parted into an ink chamber 70 on a lower side and an air chamber 71 on an upper side by an inner wall portion that is arranged to stand in the internal space of the case member 68 as shown in FIGS. 6 and 8. The ink chamber 70 is a hollow region configured to store ink and corresponds to a subordinate concept of the liquid chamber of the present disclosure. The air chamber 71 is a hollow region configured to store the atmosphere (air) introduced from the outside of the ink tank 43A and corresponds to a subordinate concept of the air chamber of the present disclosure. According to this embodiment, both the ink chamber 70 and the air chamber 71 are formed in approximately rectangular parallelepiped shapes. The volume of the air chamber 71 is smaller than the volume of the ink chamber 70.

The width of the ink chamber 70 in the direction of the arrow X is larger than the width of the air chamber 71 in the direction of the arrow X as shown in FIG. 8. An end of the air chamber 71 in the direction of the arrow X is located on an opposite direction side to the direction of the arrow X of an end of the ink chamber 70 in the direction of the arrow X. An ink filling portion 72 is provided at a position that adjoins to the air chamber 71 in the direction of the arrow X and that is located above the ink chamber 70 as shown in FIGS. 6 and 8.

The ink filling portion 72 is configured to communicate to the ink chamber 70 from the outside so as to accept the ink to be injected into the ink chamber 70. According to this embodiment, the ink filling portion 72 is configured as a cylindrical portion having a through hole 72*h* that communicates with the ink chamber 70 and is protruded upward on the second surface portion 62. A fill port 72*o* shown in FIG. 8 provided to receive ink is open on an upper edge of the ink filling portion 72. The fill port 72*o* is located at a position lower than an upper wall portion 62*a* that is located at an upper edge of the air chamber 71. The ink filling portion 72 corresponds to a subordinate concept of the liquid filling portion of the present disclosure, and the fill port 72*a* corresponds to a subordinate concept of the fill port of the present disclosure.

In the tank unit 40A, the respective ink tanks 43A are arranged such that the respective ink filling portions 72 are aligned in the direction of the arrow Y as shown in FIG. 4. The upper edge of the ink filling portion 72 in each of the ink tanks 43A is extended from the first window 42*a* of the casing portion 41 as shown in FIG. 1. A cap member 79 is generally mounted to the fill port 72*o* of the ink filling portion 72 such as to seal the fill port 72*o* air-tightly as shown in FIGS. 1 to 3. The cap member 79 may be made of, for example, a synthetic resin such as nylon or polypropylene. The user is allowed to detach the cap member 79 from the ink filling portion 72 and inject ink through the fill port 72*o*, such as to refill the ink chamber 70 with ink. In the tank unit 40A of this embodiment, the ink filling portion 72 is located on the front face side of the tank unit 40A. This configuration facilitates the user's access to the ink filling portion 72.

A lower edge structure 70*b* is provided on a lower edge of the ink chamber 70 of this embodiment to be locally protruded downward as shown in FIGS. 6 to 8. An ink supply portion 73 and an ink flow portion 75 are provided in the lower edge structure 70*b*. The ink supply portion 73 communicates the ink chamber 70 with the outside and is configured to supply the ink in the ink chamber 70 through the tube 44 into the print head unit 25 shown in FIG. 2. The ink supply portion 73 is configured as a cylindrical portion that is protruded in the opposite direction to the direction of the arrow X from the lower edge structure 70*b* of the ink chamber 70, and includes a through hole 73*h* that communicates with the ink chamber 70 as shown in FIGS. 6 and 7. The tube 44 is mounted air-tightly to the ink supply portion 73 in the direction of the arrow X as the mounting direction.

The ink flow portion 75 shown in FIGS. 6 to 8 communicates the ink chamber 70 with the outside and is configured to flow the ink between the ink chamber 70 and the corresponding ink cylinder portion 46A through the tube 47 shown in FIG. 4. The ink flow portion 75 is configured as a cylindrical portion that is protruded in the opposite direction to the direction of the arrow X from the lower edge structure 70*b* of the ink chamber 70 to be arranged parallel to the ink supply portion 73, and includes a through hole 75*h* that communicates with the ink chamber 70 as shown in FIG. 7. The tube 47 is mounted air-tightly to the ink flow portion 75 in the direction of the arrow X as the mounting direction.

As described above, in the ink tank 43A of this embodiment, the ink supply portion 73 and the ink flow portion 75 are formed at the same height. This configuration causes the detection timing of ink shortage by the indicator assembly 45 to be consistent with the timing of the ink shortage in the ink tank 43A as described later in detail. In the ink tank 43A of this embodiment, the tubes 44 and 47 are respectively connected from the same direction with the ink supply portion 73 and the ink flow portion 75 to be parallel to each other. This configuration ensures the more compact layout of the tubes 44 and 47 in the tank unit 40A.

An air introducing portion 76 is provided above the air chamber 71 as shown in FIGS. 6 to 8. The air introducing portion 76 communicates the air chamber 71 with the outside and is configured to allow the air to flow into the air chamber 71. According to this embodiment, the air introducing portion 76 is configured as a cylindrical portion that is protruded upward on the second surface portion 62, and includes a through hole 76*h* that communicates with the air chamber 71. An air release port 76*o* is provided on an upper edge of the air introducing portion 76 to be open to the outside. The air introducing portion 76 may not be necessarily provided on the second surface portion 62 but may be provided, for example, on the fourth surface portion 64.

The ink chamber 70 and the air chamber 71 are connected with each other by an air communication passage 74, such as to allow the air in the air chamber 71 to flow into the ink chamber 70 as shown in FIG. 8. According to this embodiment, the air communication passage 74 is formed as a groove that is open on an opposite direction side to the direction of the arrow Y in the case member 68 and that is extended along the outer circumferences of the ink chamber 70 and the air chamber 71 in a joint surface of the case member 68 with the film member 69. According to this embodiment, the air communication passage 74 is extended with a plurality of bends.

When the ink in the ink chamber 70 is supplied through the ink supply portion 73 to the printing unit 11 and is consumed, a negative pressure is generated inside of the ink chamber 70, so that the air is introduced from the air chamber 71 through the air communication passage 74 into the ink chamber 70. In the ink tank 43A of this embodiment, the air communication passage 74 suppresses the ink in the ink chamber 70 from flowing into the air chamber 71 and suppresses the ink in the ink chamber 70 from being vaporized and released to the outside via the air release port 76*o*. In the ink tank 43A of this embodiment, even if ink flows through the air communication passage 74 into the air chamber 71, for example, during transportation of the printer 10 in the state that the ink tank 43A is filled with ink, the air chamber 71 serves to store the ink. This configuration accordingly suppresses leakage of ink via the air introducing portion 76.

In the ink tank 43A of this embodiment, a wall portion of the case member 68 forming the third surface portion 63 is configured to be transparent or translucent such as to allow the user to visually recognize the liquid level of ink contained in the ink chamber 70. This configuration allows the user to visually recognize the amount of ink contained in the ink tank 43A, for example, when the user refills the ink tank 43A with ink. In the ink tank 43A, only the wall portion forming the third surface portion 63 may be configured to be transparent or translucent, or the entire case member 68 may be configured to be transparent or translucent.

In the tank unit 40A of this embodiment, the respective ink tanks 43A are arranged such that the respective third surface portions 63 of the ink tanks 43A are aligned along the direction of the arrow Y on the front face side of the tank unit 40A as shown in FIG. 4. The second windows 42*b* are provided in the casing portion 41 of the tank unit 40A, such as to expose the third surface portions 63 of the respective ink tanks 43A to the outside as shown in FIG. 1. This configuration enhances the user's convenience in the process of refilling the ink tank 43A with ink from the ink filling portion 72 of the ink tank 43A.

Additionally, the ink tank 43A of this embodiment is provided with a first mark 78*a* and a second mark 78*b* on the wall surface of the third surface portion 63 as shown in FIGS. 4 and 6. The first mark 78*a* indicates an upper limit position of the liquid level of ink contained in the ink chamber 70. The first mark 78*a* is formed at a position corresponding to the height of an upper edge of the ink chamber 70. The second mark 78*b* indicates a lower limit position of the liquid level of ink contained in the ink chamber 70. The second mark 78*b* is formed at a position higher than an upper edge of the lower edge structure 70*b* of the ink chamber 70. The respective marks 78*a* and 78*b* may be formed, for example, as convexes or concaves on the third surface portion 63 or may be formed by printing or by attaching stickers. The second windows 42*b* of the casing portion 41 are open such that the two marks 78*a* and 78*b* of the respective ink tanks 43A are visible from the outside as shown in FIG. 1.

As described above, providing the first mark 78*a* in each of the ink tanks 43A suppresses the ink tank 43A from being refilled with an excess amount of ink. Providing the second mark 78*b* allows the user to recognize whether the amount of ink contained in the ink tank 43A is insufficient. This accordingly suppresses the shortage of ink contained in the ink tank 43A.

[Configuration of Ink Cylinder Portion]

Figure 9:
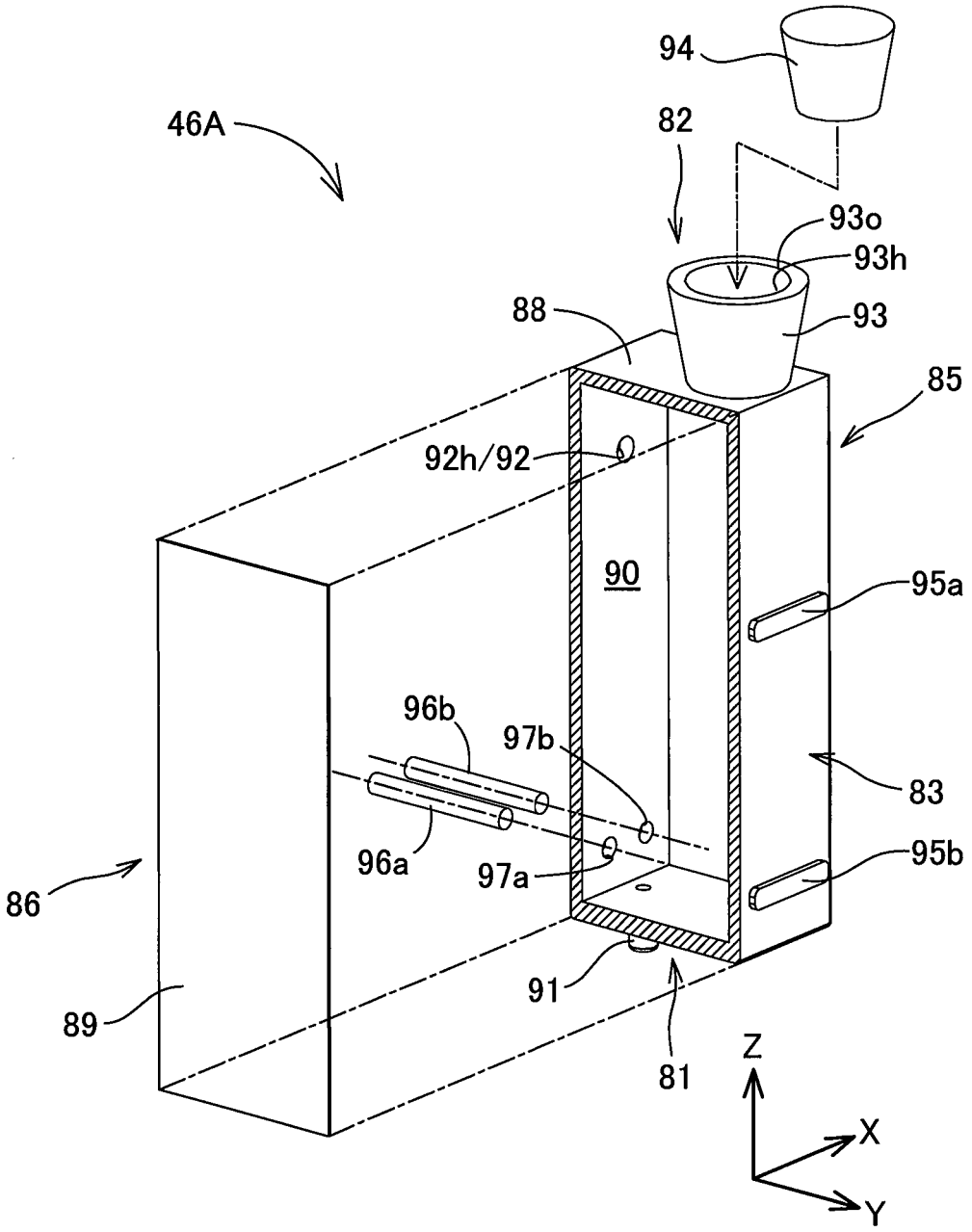
FIG. 9 is a schematic exploded perspective view illustrating an ink cylinder portion according to the first embodiment.
Figure 10:
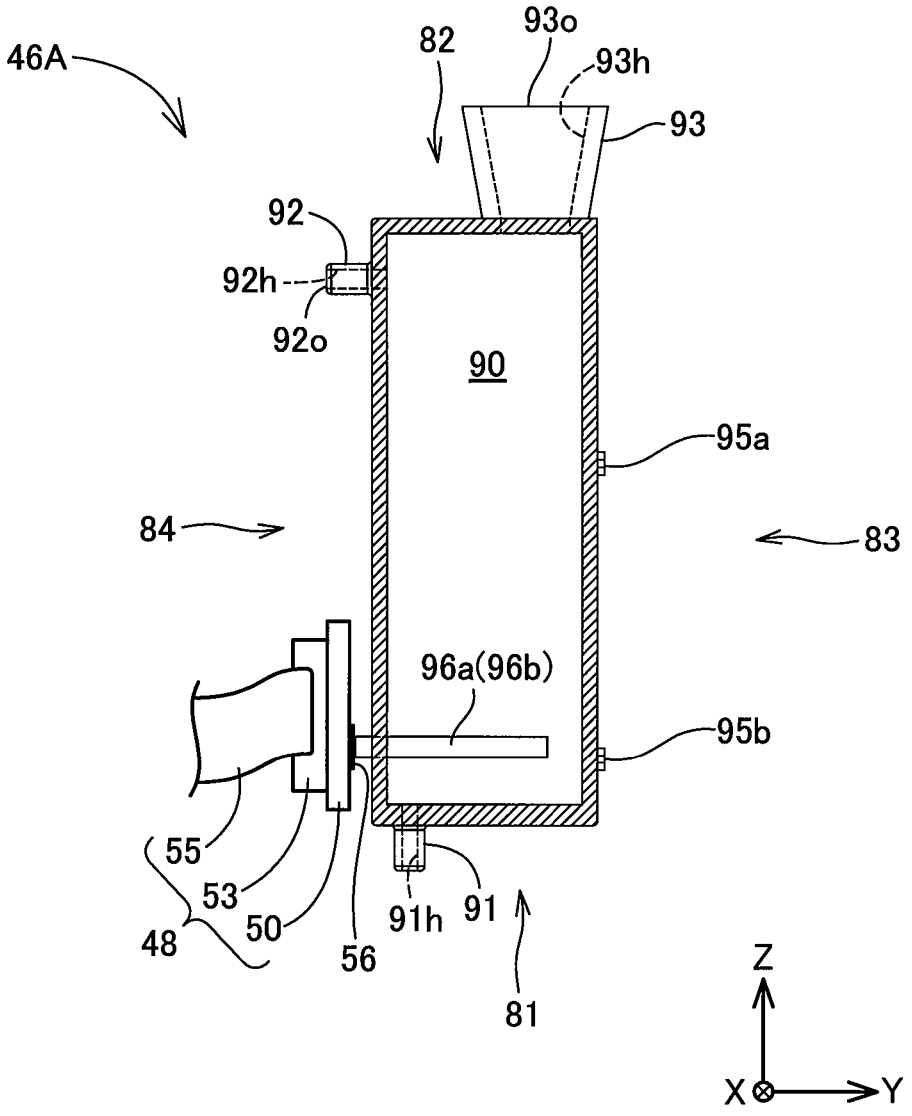
FIG. 10 is a schematic sectional view illustrating the internal configuration of the ink cylinder portion according to the first embodiment.

The configuration of the ink cylinder portion 46A is described with reference to mainly FIGS. 9 and 10. FIG. 9 is a schematic exploded perspective view illustrating the ink cylinder portion 46A. FIG. 10 is a schematic sectional view illustrating the internal structure of the ink cylinder portion 46A. FIG. 10 illustrates a schematic section of the ink cylinder portion 46A taken along a joint surface of a film member 89 as a cutting plane. Arrows X, Y and Z corresponding to those in FIGS. 1 to 3 are illustrated in FIGS. 9 and 10 with respect to the the ink cylinder portion 46A in the attitude that is fixed to the tank unit 40A coupled with the printer 10. The directions in the description below are those with respect to the ink cylinder portion 46A in the above attitude unless otherwise specified.

The ink cylinder portion 46A is configured as a hollow container including six surface portions 81 to 86 as shown in FIG. 9. A first surface portion 81 of the ink cylinder portion 46A forms a bottom surface portion that faces downward, and a second surface portion 82 forms a top surface portion that faces upward. A third surface portion 83 intersects with the first surface portion 81 and the second surface portion 82 and is arranged to face in the direction of the arrow Yin the tank unit 40A and to face the front face side of the printer 10. A fourth surface portion 84 intersects with the first surface portion 81 and the second surface portion 82 and is arranged to face in an opposite direction to the third surface portion 83. A fifth surface portion 85 intersects with all the four surface portions 81 to 84 described above and forms a right side surface portion that is located on the right side when the user faces the third surface portion 83. A sixth surface portion 86 intersects with all the four surface portions 81 to 84 and forms a left side surface portion that is located on the left side when the user faces the third surface portion 83. Similar to the ink tank 43A, a chamfered portion that forms a curved surface or the like may be placed between adjacent surface portions in the ink cylinder portion 46A.

The ink cylinder portion 46A is comprised of a case member 88 and a film member 89 as shown in FIG. 9. The case member 88 is configured as a hollow box body with an entire surface open on an opposite direction side to the direction of the arrow X and is formed in an approximately rectangular parallelepiped shape with the direction of the arrow Z as its longitudinal direction. The case member 88 may be produced by, for example, integral molding of a synthetic resin such as nylon or polypropylene. The five surface portions 81 to 85 of the ink cylinder portion 46A other than the sixth surface portion 86 are formed by outer wall portions of the case member 88.

The film member 89 is a thin film member having flexibility and is joined with the case member 88 such as to seal the entire opening of the case member 88 on the opposite direction side to the direction of the arrow X as shown in FIG. 9. The film member 89 forms the sixth surface portion 86 of the ink cylinder portion 46A. The film member 89 may be configured by, for example, a sheet member made of a synthetic resin such as nylon or polypropylene. The film member 89 may be joined with the case member 88, for example, by welding. The ink cylinder portion 46A of this embodiment is configured easily from the case member 88 and the film member 89 to be light in weight. Similar to the sixth surface portion 86, the fifth surface portion 85 forming a side surface of the ink cylinder portion 46A may also be formed by a film member 89 joined with the case member 88.

In the ink cylinder portion 46A, an ink chamber 90 provided to contain ink therein is formed as a hollow region including a space in an approximately rectangular parallelepiped shape that is long in the height direction as shown in FIG. 10. According to this embodiment, the distance in the direction of the arrow Z between an upper edge and a lower edge of the ink chamber 90 of the ink cylinder portion 46A is approximately equal to the distance in the direction of the arrow Z between an upper edge in the ink chamber 70 of the ink tank 43A and the upper edge of the lower edge structure 70*b*. The sectional area of a horizontal section, hereinafter referred to as "horizontal sectional area", in the ink chamber 90 of the ink cylinder portion 46A is smaller than the horizontal sectional area in the ink chamber 70 of the ink tank 43A over the entire length in the height direction.

An ink flow portion 91 is provided on a lower edge of the ink chamber 90. According to this embodiment, the ink flow portion 91 is configured as a cylindrical region that is protruded downward from the first surface portion 81, and includes a through hole 91*h* that communicates with the ink chamber 90. The tube 47 shown in FIG. 4 is connected air-tightly with the ink flow portion 91 in the direction of the arrow Z as the mounting direction. This configuration enables the ink contained in the ink chamber 70 of the ink tank 43A to flow through the tube 47 into the ink chamber 90 of the ink cylinder portion 46A. This configuration also enables the ink to flow from the ink chamber 90 of the ink cylinder portion 46A through the tube 47 into the ink chamber 70 of the ink tank 43A. In the tank unit 40A of this embodiment, the respective tubes 47 are placed below the respective ink tanks 43A to be extended in the opposite direction to the direction of the arrow Y.

An air introducing portion 92 is provided in an upper edge side portion that is nearer to the upper edge than the lower edge of the ink chamber 90 as shown in FIG. 10. The air introducing portion 92 communicates the ink chamber 90 with the outside and is configured to cause the air to flow into the ink chamber 90. According to this embodiment, the air introducing portion 92 is configured as a cylindrical portion that is protruded on the fourth surface portion 84, along the opposite direction of the arrow Y, and includes a through hole 92*h* that communicates with the ink chamber 90. An air release port 92*o* is provided on a leading end of the air introducing portion 92 to be open to the outside. The air introducing portion 76 may not be necessarily provided on the fourth face portion 84 but may be provided, for example, on the second surface portion 82 to be protruded upward.

In the ink cylinder portion 46A, a wall portion forming the third surface portion 83 is configured to be transparent or translucent, such that the position of the liquid level of ink contained in the ink chamber 90 is visible. As described later, the position of the liquid level of ink in the ink cylinder portion 46A corresponds to the position of the liquid level of ink in the ink tank 43A. This configuration enables the user to visually recognize the amount of ink contained in the ink tank 43A, based on the position of the liquid level of ink in the ink cylinder portion 46A. In the ink cylinder portion 46A, only the wall portion forming the third surface portion 83 may be configured to be transparent or translucent, or the entire case member 88 may be configured to be transparent or translucent. The third surface portion 83 of the ink cylinder portion 46A according to this embodiment corresponds to a subordinate concept of the visible portion of the present disclosure.

In the tank unit 40A of this embodiment, the plurality of ink cylinder portions 46A are arranged such that the respective third surface portions 83 are aligned along the direction of the arrow X on the front face side of the printer 10 as shown in FIG. 4. The third window 42*c* is provided in the casing portion 41 of the tank unit 40A, such as to expose the third surface portions 83 of the respective ink cylinder portions 46A to be visible from the outside as shown in FIG. 1. As described above, in the printer 10 of this embodiment, the ink cylinder portions 46A indicating the amounts of inks contained in the respective ink tanks 43A are collectively arranged on the front face side which the user faces in the ordinary use of the printer 10. This configuration enhances the user's convenience.

An ink filling portion 93 is provided on the second surface portion 82, such as to allow the user to refill the ink chamber 90 with ink as shown in FIGS. 9 and 10. The ink injected from the ink filling portion 93 of the ink cylinder portion 46A into the ink chamber 90 flows through the tube 47 that is connected with the ink flow portion 91, into the ink chamber 70 of the ink tank 43A.

According to this embodiment, the ink filling portion 93 is configured as a cylindrical portion that is protruded upward, and includes a through hole 93*h* that communicates with the ink chamber 90. A fill port 93*o* provided to receive ink is open to the outside on an upper edge of the ink filling portion 93. The ink filling portion 93 of this embodiment is substantially tapered such as to increase the opening diameter of the through hole 93*h* upward. This configuration suppresses ink spilling during ink refilling.

In the tank unit 40A, the respective ink cylinder portions 46A are arranged such that the respective ink filling portions 93 are aligned in the direction of the arrow X on the front face side of the printer 10 as shown in FIG. 4. Upper edges of the ink filling portions 93 of the respective ink cylinder portions 46A are extended from the fourth window 42*d* of the casing portion 41 as shown in FIG. 1. As described above, in the printer 10 of this embodiment, the ink filling portions 93 used to refill the respective ink tanks 43A with ink are collectively arranged on the front face side of the printer 10. This configuration enhances the user's convenience. This configuration also allows the user to supply ink while checking the position of the liquid level of ink on the third surface portion 83 of each ink cylinder portion 46A. This accelerates adjustment of the amount of ink contained in the ink tank 43A.

According to this embodiment, a cap member 94 is generally mounted to the fill port 93*o* of the ink filling portion 93 such as to seal the fill port 93*o* air-tightly as shown in FIG. 9. The cap member 94 may be made of, for example, a synthetic resin such as nylon or polypropylene. The user is allowed to detach the cap member 94 from the ink filling portion 93 and refill the ink chamber 90 with ink. The cap member 94 suppresses vaporization of ink from the ink chamber 90 and also suppresses extraneous substances from entering the ink chamber 90. The cap member 94 corresponds to a subordinate concept of the sealing member of the present disclosure.

The ink cylinder portion 46A of this embodiment is provided with a first mark 95*a* and a second mark 95*b* on the wall surface of the third surface portion 83 as shown in FIGS. 9 and 10. The first mark 95*a* indicates an upper limit position of the liquid level of ink contained in the ink chamber 90 of the ink tank 43A. The first mark 95*a* is formed at approximately the same height as that of the first mark 78*a* of the ink tank 43A. The second mark 95*b* is formed at approximately the same height as that of the second mark 78*b* of the ink tank 43A. In the description hereof, the term "approximately the same" or "approximately equal" means substantially the same or substantially equal and includes an error range of approximately ±5% by taking into account the tolerance.

The respective marks 95*a* and 95*b* may be formed, for example, as convexes or concaves on the third surface portion 83 or may be formed by printing or by attaching stickers. The third window 42*c* of the casing portion 41 is open such that the two marks 95*a* and 95*b* of the respective ink cylinder portions 46A are visible from the outside as shown in FIG. 1.

Providing the first mark 95*a* in each of the ink cylinder portions 46A suppresses the corresponding ink tank 43A from being refilled with an excess amount of ink when the user supplies ink through the ink cylinder portion 46A. Providing the second mark 95*b* in each of the ink cylinder portions 46A allows the user who faces the printer 10 to check whether the amount of ink contained in the corresponding ink tank 43A is insufficient. This accordingly suppresses the shortage of ink contained in the ink tank 43A.

A pair of terminal pins 96*a* and 96*b* are mounted on a lower edge side of each ink cylinder portion 46A as a detection element used for detection of ink as shown in FIG. 9. The respective terminal pins 96*a* and 96*b* may be configured by, for example, metal pins such as stainless steel. It is preferable that the respective terminal pins 96*a* and 96*b* are made of a material that is unlikely to produce an oxide layer when being exposed to ink or material that is surface-treated to suppress such production of an oxide layer. A pair of through holes 97*a* and 97*b* are provided in a wall portion of the case member 88 that forms the fourth surface portion 84 to mount the pair of terminal pins 96*a* and 96*b*. The first terminal pin 96*a* is inserted into the first through hole 97*a*, and the second terminal pin 96*b* is inserted into the second through hole 97*b*.

According to this embodiment, the first terminal pin 96*a* and the second terminal pin 96*b* are maintained horizontally at approximately the same heights to be arranged in the direction of the arrow Y as their longitudinal directions. According to this embodiment, the pair of terminal pins 96*a* and 96*b* are provided at approximately the same height as the second mark 95*b*. It is desirable to place seal members or the like between the first terminal pin 96*a* and the inner circumferential surface of the first through hole 97*a* and between the second terminal pin 96*b* and the inner circumferential surface of the second through hole 97*b*, in order to suppress leakage of ink. The pair of terminal pins 96*a* and 96*b* may be arranged in parallel to each other in the direction of the arrow Z.

FIG. 10 schematically illustrates the state that the terminal connecting assembly 48 is connected with the respective terminal pins 96*a* and 96*b*. In the tank unit 40A, the terminal connecting assembly 48 is arranged such that each of the terminal pins 96*a* and 96*b* is allowed to electrically come into contact with corresponding one of a plurality of terminals 56 provided on the first substrate surface 51 of the substrate portion 50. This configuration causes the pair of terminal pins 96*a* and 96*b* to be electrically connected with the signal processor 22 of the printing unit 11 shown in FIG. 2.

[Detection of Ink in Tank Unit]

Figure 11:
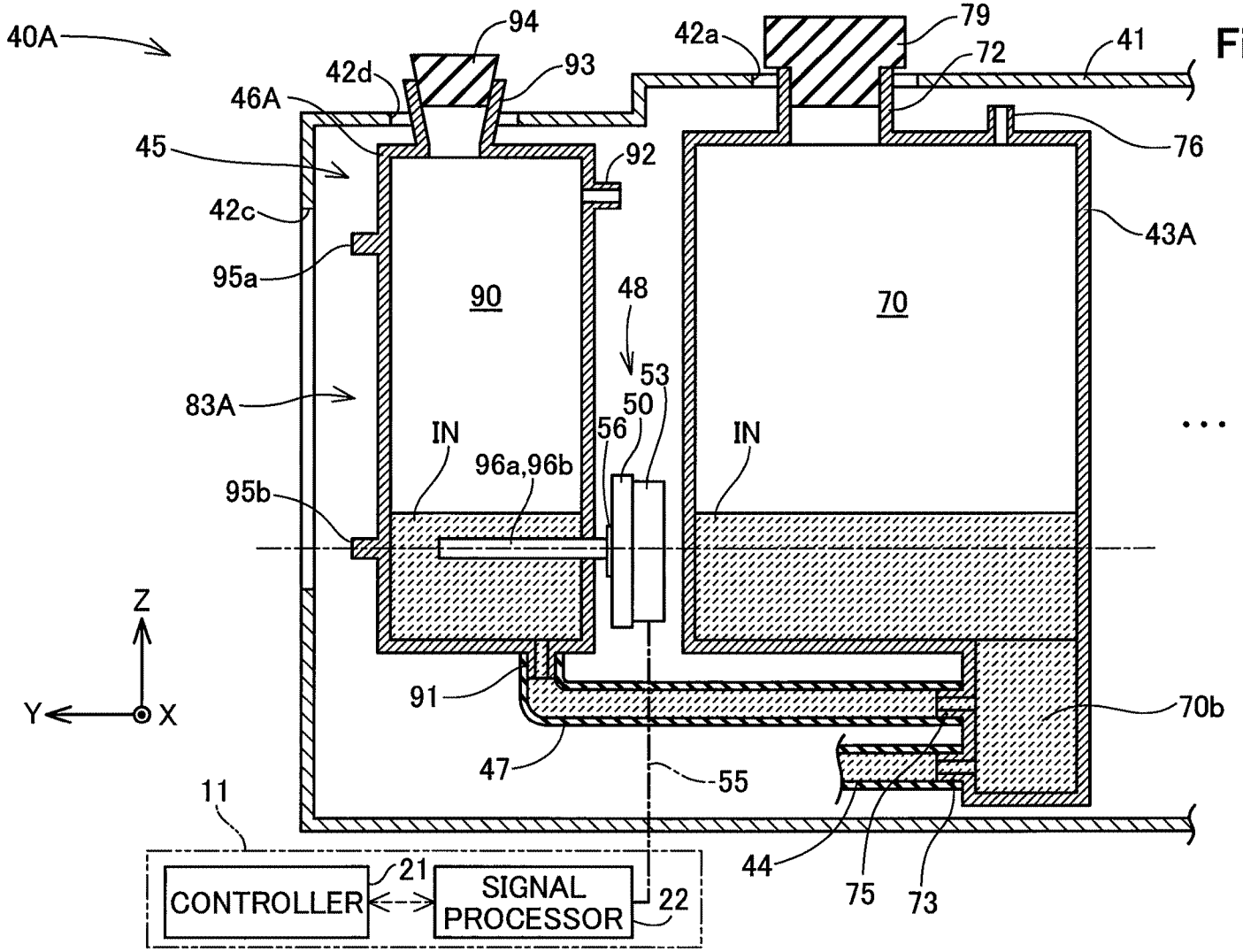
FIG. 11 is a diagram illustrating an operation of ink detection in the printer according to the first embodiment.

FIG. 11 is a diagram illustrating an operation of ink detection in the printer 10. FIG. 11 schematically illustrates one set of the ink tank 43A and the ink cylinder portion 46A in the tank unit 40A. As a matter of convenience, the air chamber 71 and the air communication passage 74 of the ink tank 43A are omitted from the illustration of FIG. 11, and the ink supply portion 73 and the ink flow portion 75 are illustrated to be arranged in the direction of the arrow Z in FIG. 11. FIG. 11 also illustrates the controller 21 and the signal processor 22 of the printing unit 11 and further illustrates the wiring cable 55 by a one-dot chain line.

The ink chamber 70 of the ink tank 43A and the ink chamber 90 of the ink cylinder portion 46A are connected with each other via the tube 47 in their lower portions where ink IN is stored. The air is introduced through the air introducing portion 76 into the ink chamber 70 of the ink tank 43A, while the air is introduced through the air introducing portion 92 into the ink chamber 90 of the ink cylinder portion 46A. This causes the height position of the liquid level of the ink IN in the ink tank 43A to correspond to and to be approximately equal to the height position of the liquid level of the ink IN in the ink cylinder portion 46A. This accordingly enables the user to check the amount of ink contained in the corresponding ink tank 43A via the third surface portion 83 of the ink cylinder portion 46A.

In the printer 10 of the embodiment, the controller 21 shown in FIG. 2 performs the management process with regard to the amount of ink contained in the tank unit 40A as described below. The controller 21 causes the signal processor 22 to periodically apply electric current to the first terminal pin 96*a* for detection of the ink IN contained in each of the ink cylinder portions 46A during execution of a printing process or during stop of the printing process. The signal processor 22 detects a change in resistance between the first terminal pin 96*a* and the second terminal pin 96*b* and outputs the detected change to the controller 21.

When the ink IN is consumed in the ink tank 43A, the position of the liquid level of the ink IN is lowered in the corresponding ink cylinder portion 46A. When the position of the liquid level of the ink IN in the ink cylinder portion 46A becomes lower than the position of the respective terminal pins 96*a* and 96*b*, this breaks electrical continuity between the terminal pins 96*a* and 96*b* and increases the resistance between the terminal pins 96*a* and 96*b*. When the resistance detected by the signal processor 22 increases to or above a predetermined reference value, the controller 21 detects the insufficient remaining amount of ink in the ink tank 43A.

As described above, according to this embodiment, the presence or the absence of the ink IN is detected at the position where the terminal pins 96*a* and 96*b* are placed. The height position where the pair of terminal pins 96*a* and 96*b* are placed according to this embodiment corresponds to a subordinate concept of the detecting position of the present disclosure. When the pair of terminal pins 96*a* and 96*b* are arranged in the direction of the arrow Z as described above, the height position of the terminal pin located on the upper side corresponds to a subordinate concept of the detecting position of the present disclosure.

When detecting the insufficient remaining amount of ink in the ink tank 43A, the controller 21 performs a notification process to notify the user of the timing of ink refilling. The controller 21 also starts counting the remaining number of times of capabe of ejecting ink droplets from the print head unit 25. When the remaining number of times becomes equal to zero, the controller 21 interrupts the printing process and notifies the user of out of ink in the ink tank 43.

In the printer 10 of this embodiment, it may be construed that the controller 21, the signal processor 22, the terminal connecting assembly 48 and the pair of terminal pins 96*a* and 96*b* as the detection elements constitute a detector that allows for detection of ink contained in the ink cylinder portion 46A. The terminal connecting assembly 48 that is placed outside of the ink cylinder portion 46A and that is configured to transmit electric signals to and from the pair of terminal pins 96*a* and 96*b* according to this embodiment corresponds to a subordinate concept of the connecting assembly of the present disclosure.

According to this embodiment, as described above, the horizontal sectional area in the ink chamber 90 of the ink cylinder portion 46A is smaller than the horizontal sectional area in the ink chamber 70 of the ink tank 43A over the entire length in the height direction including the placement position of the terminal pins 96*a* and 96*b*. Even when the tank unit 40A is arranged to be inclined relative to a horizontal line, this configuration reduces a change in position of the liquid level of the ink IN in the ink cylinder portion 46A at the height position where the terminal pins 96*a* and 96*b* are placed, compared with a change in the ink tank 43A. Accordingly this configuration reduces the possibility of misdetection of ink shortage caused by inclination of the placement angle of the tank unit 40A, compared with a configuration that the ink tank 43A is provided with the terminal pins 96*a* and 96*b* and detection of ink is performed in the ink tank 43A. This is not limited to the case where the tank unit 40A is arranged to be inclined but is also applicable to the case where the tank unit 40A is arranged in an unstable state such as to swing.

[Layout Configuration of Ink Tanks and Ink Cylinder Portions in Tank Unit]

Figure 12:
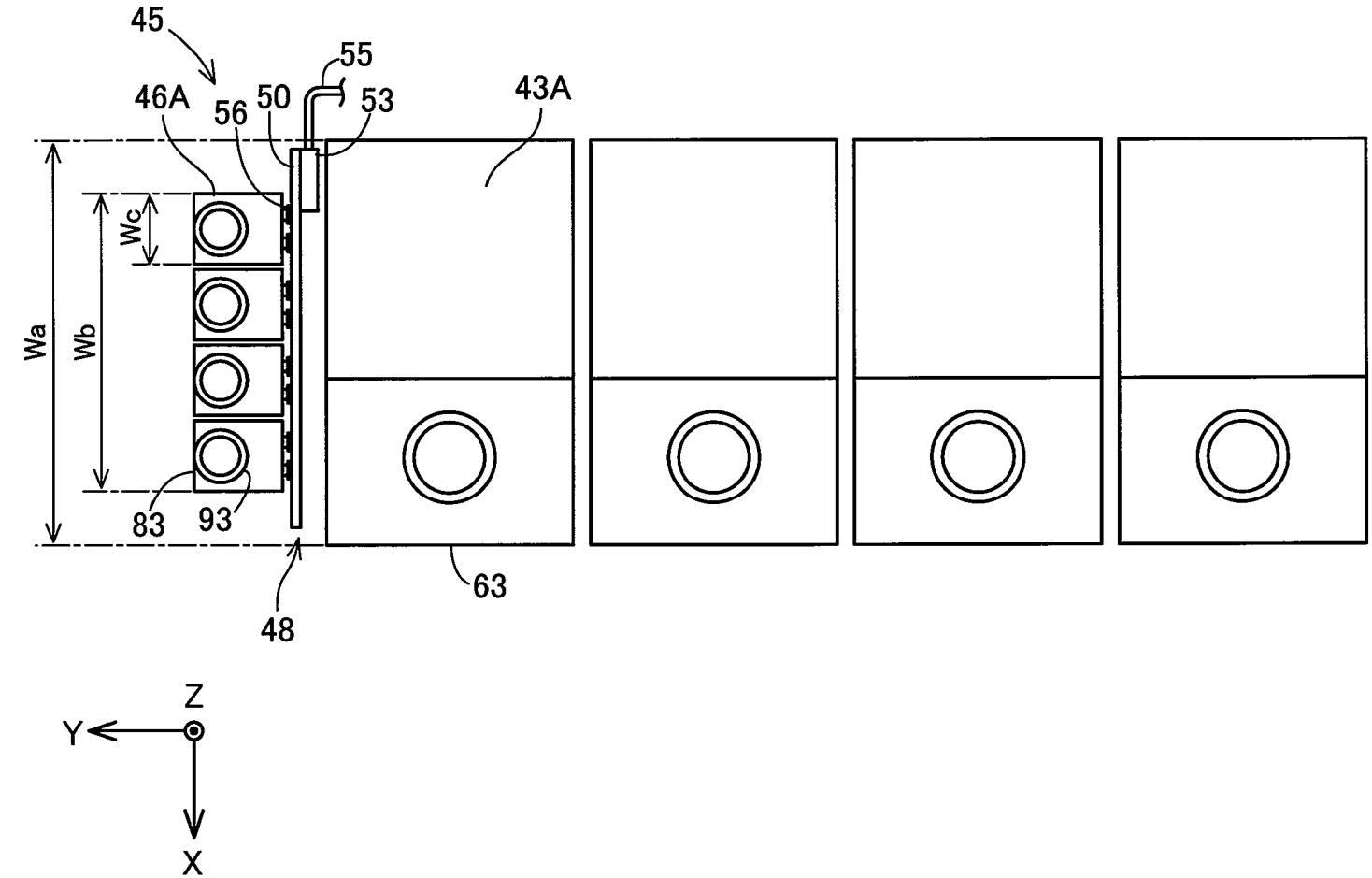
FIG. 12 is a schematic diagram illustrating the layout configuration of ink tanks and an indicator assembly in the tank unit according to the first embodiment.

FIG. 12 is a schematic diagram illustrating the layout configuration of the ink tanks 43A and the indicator assembly 45 when the tank unit 40A is viewed in an opposite direction to the direction of the arrow Z. In the tank unit 40A of this embodiment, the plurality of ink tanks 43A are aligned in the direction of the arrow Y, and the plurality of ink cylinder portions 46A included in the indicator assembly 45 are aligned in the direction of the arrow X. The array of the ink tank 43A corresponds to a subordinate concept of the first liquid container array of the present disclosure, and the array of the ink cylinder portions 46A corresponds to a subordinate concept of the second liquid container array.

As described above, in the tank unit 40A of this embodiment, the ink tanks 43A and the ink cylinder portions 46A are separately arranged in a collective manner. This configuration enhances the user's convenience. The array of the ink cylinder portions 46A included in the indicator assembly 45 is placed on the front face side of the printer 10, and the array of the ink tanks 43A is placed behind the array of the ink cylinder portions 46A. This layout configuration facilitates the user's access to the indicator assembly 45 and accordingly facilitates the user's management of the amounts of inks in the respective ink tanks 43A.

In the tank unit 40A of this embodiment, the detector is provided for detection of the remaining amount of ink with regard to the ink cylinder portion 46A included in the indicator assembly 45. This configuration suppresses size expansion of the detector accompanied with size expansion of each ink tank 43A for the purpose of increasing the ink capacity of each ink tank 43A.

In the tank unit 40A of this embodiment, the respective ink cylinder portions 46A are arranged collectively as described above. This configuration allows for downsizing of the terminal connecting assembly 48 that is commonly connected with the respective ink cylinder portions 46A. More specifically, in the tank unit 40A of this embodiment, a width Wb of the array of the ink cylinder portions 46A in the direction of the arrow X is smaller than a width Wa of the array of the ink tanks 43A in the direction of the arrow X. This configuration allows for downsizing of not only the terminal connecting assembly 48 but the indicator assembly 45 itself. This contributes to downsizing of the tank unit 40A and the printer 10.

According to this embodiment, a width Wc of each cylinder portion 46A in the direction of the arrow X is equal to or smaller than one fourth the width Wa of each ink tank 43A in the direction of the arrow X. When the tank unit 40A is provided with n ink tanks 43A and n ink cylinder portions 46A where n denotes a natural number of not less than 1, the width Wc of each ink cylinder portion 46A in the direction of the arrow X is equal to or less than one n-th the width Wa of each ink tank 43A in the direction of the arrow X. As described above, in the tank unit 40A of this embodiment, each ink cylinder portion 46A is configured to have smaller dimensions than those of each corresponding ink tank 43A. This configuration accordingly has the greater effect of reducing the possibility of misdetection of ink shortage caused by a change in position of the liquid level of the ink IN described above.

In the tank unit 40A of this embodiment, the terminal connecting assembly 48 is placed in the gap between an end of the array of the ink tanks 43A and the respective ink cylinder portions 46A. This configuration enhances the use efficiency of the space in the tank unit 40A. Placing the terminal connecting assembly 48 at such a deep position suppresses the user from accidentally touching the terminal connecting assembly 48 and enhances the protection of the terminal connecting assembly 48.

Additionally, the tank unit 40A of this embodiment enables the user to supply ink into the ink tank 43A while visually checking the amount of ink and also enables the user to supply ink into the ink cylinder portion 46A while visually checking the amount of ink. This also enhances the user's convenience. In the tank unit 40A of this embodiment, ink is supplied to the printing unit 11 from both the ink tank 43A and the ink cylinder portion 46A. As described above, in the tank unit 40A of this embodiment, the ink tank 43A of the larger capacity serves as a main tank, and the ink cylinder portion 46A of the smaller capacity serves as a sub tank that assists the main tank.

CONCLUSIONS

As described above, the tank unit 40A of this embodiment reduces the possibility of misdetection of ink shortage caused by the layout of the tank unit 40A and enhances the detection accuracy of ink. The printer 10 of this embodiment is provided with the tank unit 40A and accordingly enhances the management performance with regard to the amount of ink contained in the ink tank 43A. Additionally, the tank unit 40A of this embodiment and the printer 10 provided therewith have various functions and advantageous effects described above.

B. Second Embodiment

Figure 13:
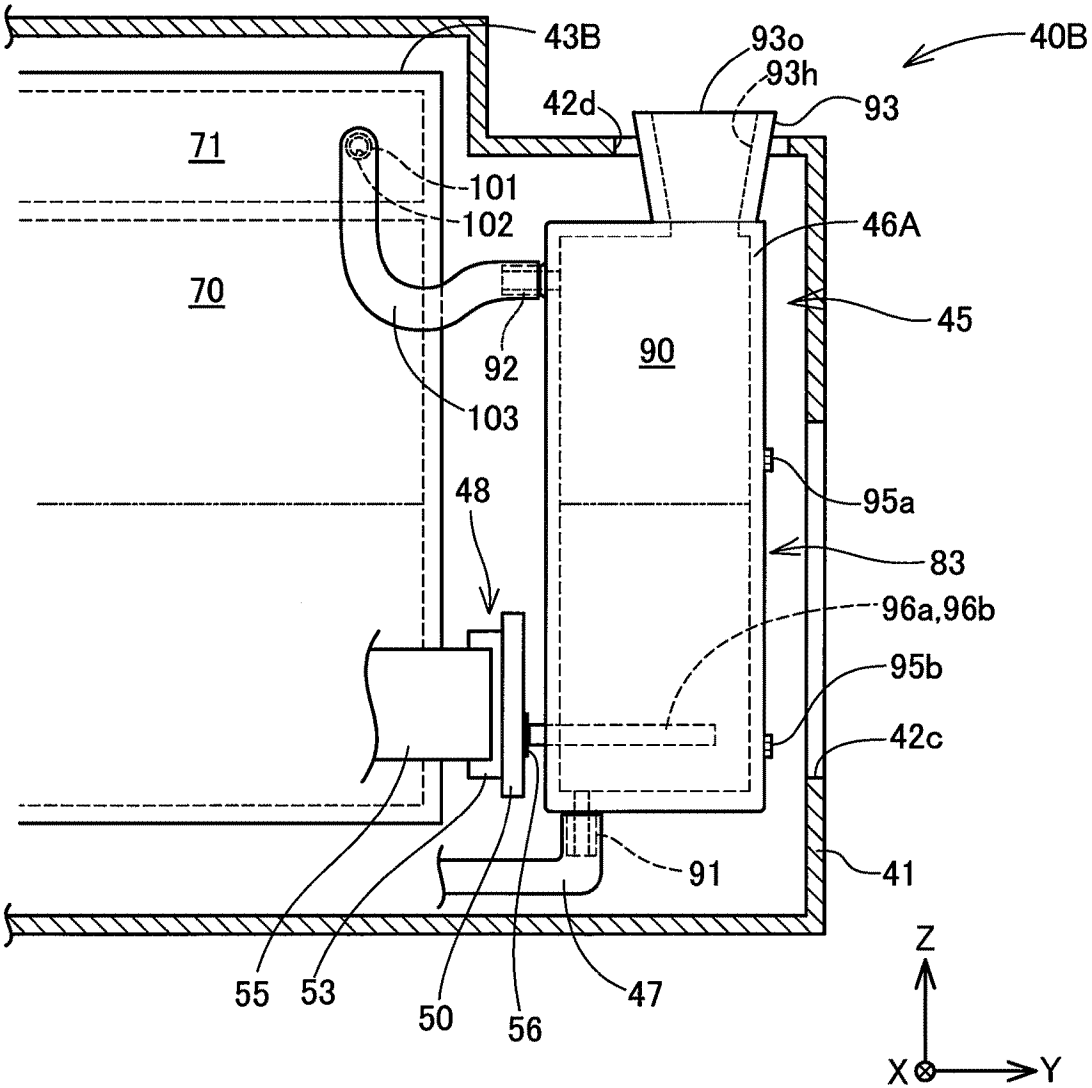
FIG. 13 is a schematic sectional view illustrating the internal configuration of a tank unit according to a second embodiment.

FIG. 13 is a schematic sectional view illustrating the internal configuration of a tank unit 40B according to a second embodiment of the present disclosure. FIG. 13 illustrates part of the internal configuration of a casing portion 41 when the tank unit 40B is viewed in the direction of the arrow X. The tank unit 40B of the second embodiment has a substantially similar configuration to that of the tank unit 40A of the first embodiment, except aspects described below and is mounted to a printer having a similar configuration to that of the printer 10 described in the first embodiment shown in FIGS. 1 and 2. In the description below and the reference drawing, similar components to those described in the first embodiment or corresponding components are expressed by using the common names and reference signs to those used in the first embodiment.

An ink tank 43B included in the tank unit 40B has a substantially similar configuration to that of the ink tank 43A described in the first embodiment, except an air flow portion 101 provided to communicate with an air chamber 71. The air flow portion 101 is configured as a cylindrical region that is protruded in the opposite direction to the direction of the arrow X on a fifth surface portion 65 of the ink tank 43B, and includes a through hole 102 that communicates with the air chamber 71.

The tank unit 40B includes a plurality of tubes 103. Each of the tubes 103 may be made of, for example, a resin material having flexibility. One end of the tube 103 is connected air-tightly with the air flow portion 101 of each of the ink tanks 43B, and the other end of the tube 103 is connected air-tightly with an air introducing portion 92 of a corresponding ink cylinder portion 46A. In the tank unit 40B, the air chamber 71 of each ink tank unit 43B and an ink chamber 90 of each ink cylinder portion 46A are connected with each other by the tube 103 such as to allow the air to flow therebetween. The tube 10 of this embodiment corresponds to a subordinate concept of the air flow passage of the present disclosure.

In the tank unit 40B of the second embodiment, the air is introduced into the ink chamber 90 of the ink cylinder portion 46A via the air chamber 71 of the corresponding ink tank 43B. This configuration causes the conditions of the air, for example, the atmospheric pressure and the temperature, in the in chamber 90 of the ink cylinder portion 46A to be substantially equal to the conditions in the ink chamber 70 of the ink tank 43B. This configuration accordingly causes the position of the liquid level of ink in the ink cylinder portion 46A to be equal to the position of the liquid level of ink in the corresponding ink tank 43B with the higher accuracy and enhances the detection accuracy of ink and the management performance of ink in the printer.

In the tank unit 40B of the second embodiment, the ink chamber 70 of the ink cylinder portion 46A does not directly communicate with the outside. This simple configuration suppresses vaporization of ink from the ink cylinder portion 46A. Furthermore, the tube 103 is connected with the air chamber 71 of the ink tank 43B. This configuration suppresses ink in the ink chamber 70 of the ink tank 43B from flowing into the ink cylinder portion 46A via the tube 103. Additionally, the tank unit 40B of the second embodiment and the printer provided therewith have various functions and advantageous effects similar to those described in the first embodiment.

C. Third Embodiment

Figure 14:
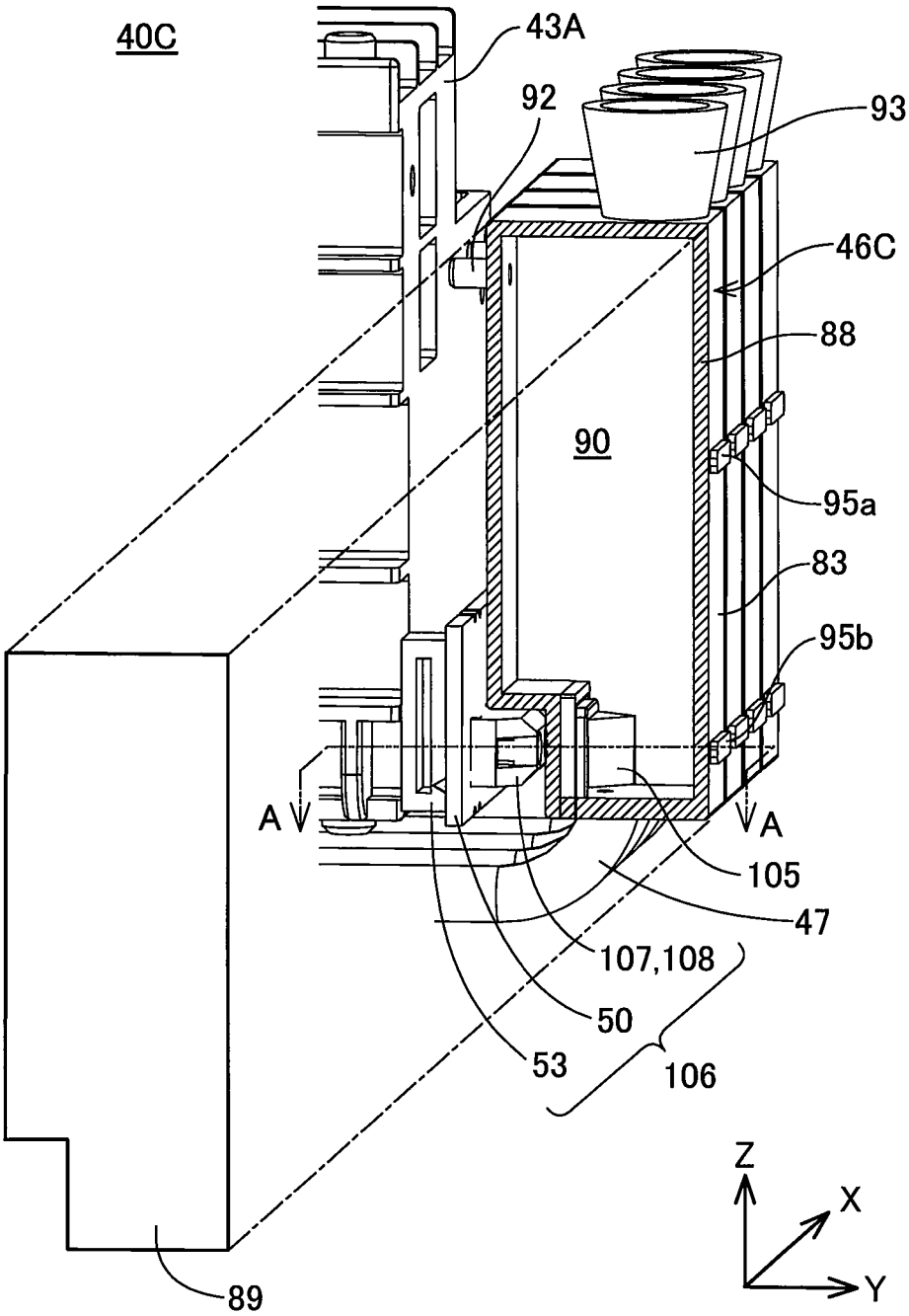
FIG. 14 is a schematic exploded perspective view illustrating the configuration of a tank unit according to a third embodiment.

FIG. 14 is a schematic exploded perspective view illustrating the configuration of a tank unit 40C according to a third embodiment of the present disclosure. FIG. 14 illustrates the state that a film member 89 is separated from one of a plurality of ink cylinder portions 46C included in an indicator assembly 45 placed in a casing portion 41 of the tank unit 40C. As a matter of convenience, the wiring cable 55 is omitted from the illustration of FIG. 14. The tank unit 40C of the third embodiment has a substantially similar configuration to that of the tank unit 40A of the first embodiment, except aspects described below and is mounted to a printer having a similar configuration to that of the printer 10 described in the first embodiment shown in FIGS. 1 and 2. In the description below and the reference drawings, similar components to those described in the first embodiment or corresponding components are expressed by using the common names and reference signs to those used in the first embodiment.

In the tank unit 40C of the third embodiment, a detector that allows for detection of ink in each of the ink cylinder portions 46C is configured by optical means. In the tank unit 40C of the third embodiment, a triangular prism 105 is provided as a detection element used for detection of ink in an ink chamber 70 of each ink cylinder portion 46C, in place of the pair of terminal pins 96*a* and 96*b*. The triangular prism 105 may be made of, for example, an acrylic resin. In the tank unit 40C, an optical sensor structure 106 is provided between an array of the ink cylinder portions 46C and an array of ink tanks 43A, in place of the terminal connecting assembly 48. The optical sensor structure 106 has a similar configuration to that of the terminal connecting assembly 48, except that multiple sets of light-emitting elements and light-receiving elements are provided on a substrate surface of a substrate portion 50, in place of the plurality of terminals 56.

Figure 15A:
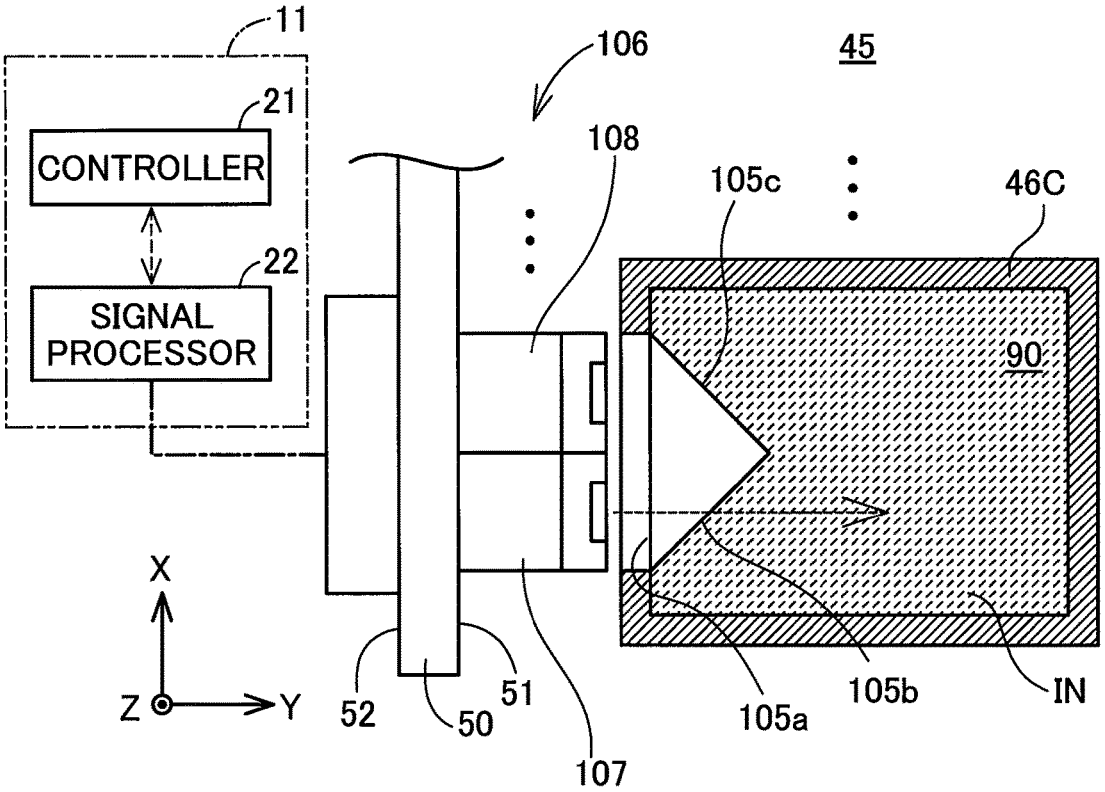
FIG. 15A is a first schematic diagram illustrating an operation of an ink detector in an indicator assembly according to the third embodiment.
Figure 15B:
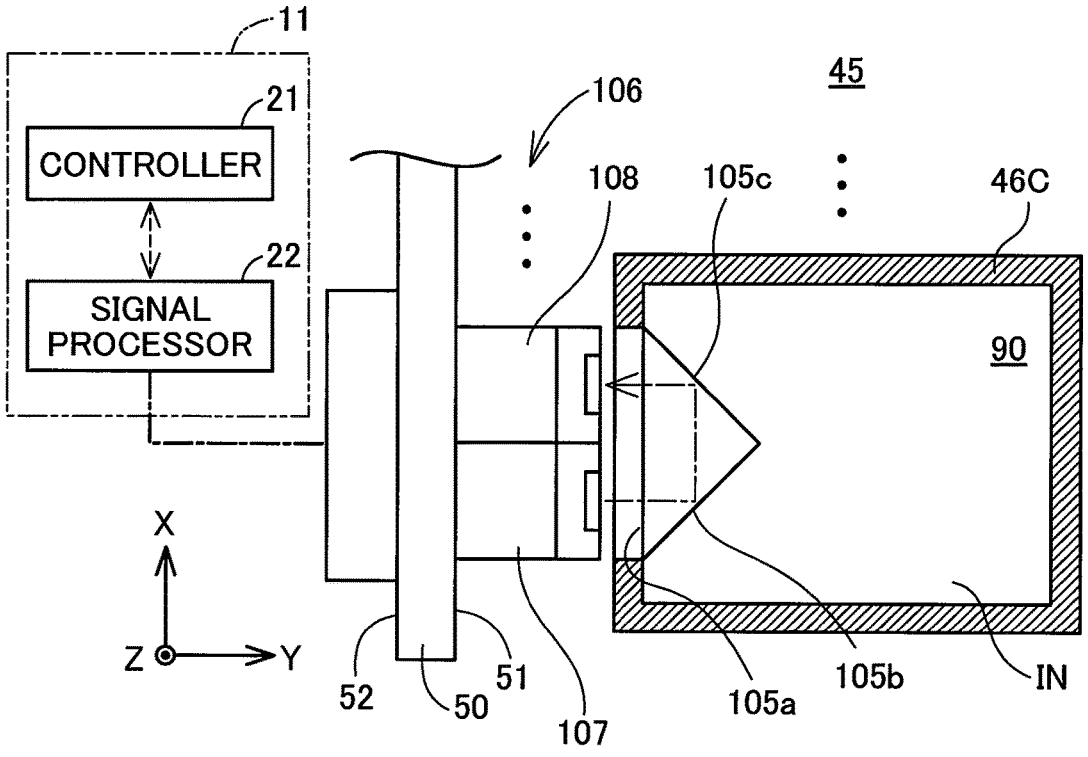
FIG. 15B is a second schematic diagram illustrating the operation of the ink detector in the indicator assembly according to the third embodiment.

FIG. 15A and FIG. 15B are schematic diagrams illustrating an operation of ink detection in the indicator assembly 45 according to the third embodiment. FIG. 15A and FIG. 15B respectively illustrate the schematic section of an indicator assembly 45 taken along a line A-A shown in FIG. 14. FIG. 15A illustrates the state that the ink chamber 70 of the ink cylinder portion 46C is sufficiently filled with ink. FIG. 15B illustrates the state of ink shortage in the ink chamber 70 of the ink cylinder portion 46C. FIG. 15A and FIG. 15B also respectively illustrate the controller 21 and the signal processor 22 of the printing unit 11 and further illustrates the wiring cable 55 by a one-dot chain line.

In each of the ink cylinder portions 46C of the third embodiment, the triangular prims 105 is placed in a lower edge side portion of the ink chamber 70 such that a first surface 105 thereof is arranged along the direction of the arrow X. In an indicator assembly 45 of the third embodiment, one set of the light-emitting element 107 and the light-receiving element 108 are provided for each of the plurality of ink cylinder portions 46C. The light-emitting element 107 and the light-receiving element 108 are arranged adjacent to each other in the direction of the arrow X on the substrate portion 50. Both the light-emitting element 107 and the light-receiving element 108 are arranged to face the first surface 105*a* of the triangular prism 105. The light-emitting element 107 is arranged to face a second surface 105*b* across the first surface 105*a*, and the light-receiving element 108 is arranged to face a third surface 105*c* across the first surface 105*a*.

The indicator assembly 45 of the third embodiment detects ink in each ink cylinder portion 46C as described below. The controller 21 causes the signal processor 22 to periodically apply electric current to the optical sensor structure 106 and thereby causes the light-emitting element 107 of the optical sensor structure 106 to periodically emit light. When the periphery of the triangular prism 105 is filled with the ink IN, the light entering from the light-emitting element 107 to the triangular prism 105 is diffused in the ink IN as shown in FIG. 15A, since the refractive index of the triangular prism 105 is close to the refractive index of the ink IN. In this case, no light-receiving signal is output from the light-receiving element 108 to the signal processor 22, so that the controller 21 determines that there is no ink shortage in the ink tank 43A corresponding to the ink cylinder portion 46C.

When no ink IN is present in the periphery of the triangular prism 105, on the other hand, the light entering from the light-emitting element 107 to the triangular prism 105 is reflected from both the second surface 105*b* and the third surface 105*c* and is emitted from the first surface 105*a* as shown in FIG. 15B. In this case, the light-receiving element 108 receives the light emitted from the first surface 105*a* and outputs a light-receiving signal to the signal processor 22. When receiving the light-receiving signal from the signal processor 22, the controller 21 determines that there is ink shortage in the ink tank 43A corresponding to the ink cylinder portion 46C.

In the printer 10 of the third embodiment, the controller 21, the signal processor 22, the triangular prism 105 as the detection element and the optical sensor structure 106 constitute a detector that allows for detection of ink by the optical means. The height position where the light from the light-emitting element 107 enters the triangular prism 105 according to the third embodiment corresponds to a subordinate concept of the detecting position of the present disclosure. The optical sensor structure 106 that is placed outside of the ink cylinder portion 46C and that is configured to transmit optical signals to and from the triangular prism 105 as the detection element according to the third embodiment corresponds to a subordinate concept of the connecting assembly of the present disclosure.

As described above, in the tank unit 40C of the third embodiment, ink in each cylinder portion 46C is detected by the optical means. Additionally, the tank unit 40C of the third embodiment and the printer provided therewith have functions and advantageous effects similar to those described in the first embodiment.

D. Fourth Embodiment

Figure 16:
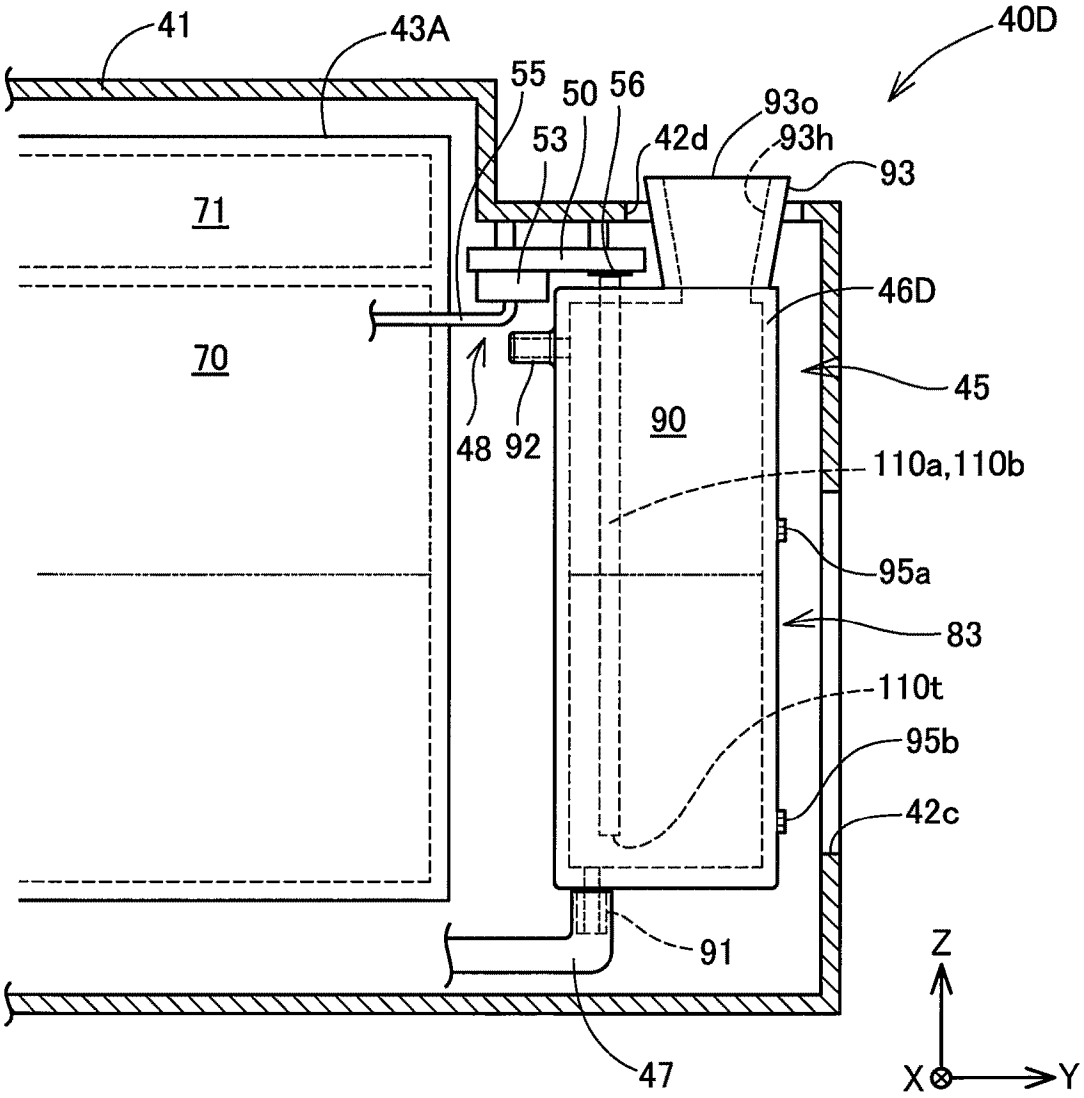
FIG. 16 is a schematic sectional view illustrating the internal configuration of a tank unit according to a fourth embodiment.

FIG. 16 is a schematic sectional view illustrating the internal configuration of a tank unit 40D according to a sixth embodiment of the present disclosure. FIG. 16 illustrates part of the internal configuration of a casing portion 41 when the tank unit 40D is viewed in the direction of the arrow X. The tank unit 40D of the fourth embodiment has a substantially similar configuration to that of the tank unit 40A of the first embodiment, except aspects described below and is mounted to a printer having a similar configuration to that of the printer 10 described in the first embodiment shown in FIGS. 1 and 2. In the description below and the reference drawing, similar components to those described in the first embodiment or corresponding components are expressed by using the common names and reference signs to those used in the first embodiment.

An ink cylinder portion 46D included in the tank unit 40D of the fourth embodiment is provided with a pair of terminal pins 110*a* and 110*b* that are inserted in the vertical direction as detection elements, in place of the pair of terminal pins 96*a* and 96*b* that are inserted in the horizontal direction. The pair of terminal pins 110*a* and 110*b* are inserted in the vertical direction through a pair of through holes 111*a* and 111*b* that are provided to be arrayed in the direction of the arrow X in a second surface portion 82 of the ink cylinder portion 46D. The first terminal pin 110*a* is inserted into the first through hole 111*a*, and the second terminal pin 110*b* is inserted into the second through hole 111*b*. It is desirable to place seal members between the first terminal pin 110*a* and the inner circumferential surface of the first through hole 111*a* and between the second terminal pin 110*b* and the inner circumferential surface of the second through hole 111*b*, in order to ensure the air tightness in an ink chamber 70.

The pair of terminal pins 110*a* and 110*b* are held in the ink chamber 70 such that respective lower edges 110*t* are located at positions on a lower edge side of the ink chamber 70 and higher than the lower edge of the ink chamber 70. The lower edges 110*t* of the respective terminal pins 110*a* and 110*b* may be located at approximately the same height as that of the second mark 95*b*. In the tank unit 40D, a terminal connecting assembly 48 is hung in an upper region of each ink cylinder portion 46D, such that each of terminals 56 of a first substrate surface 51 is allowed to electrically come into contact with corresponding one of the terminal pins 110*a* and 110*b* of each ink cylinder portion 46D.

Similar to the first embodiment described above, in the printer provided with the tank unit 40D of the fourth embodiment, the controller 21 causes the signal processor 22 to periodically apply electric current to the first terminal pin 110*a* of each ink cylinder portion 46D. When the resistance between the two terminal pins 110*a* and 110*b* detected by the signal processor 22 is equal to or higher than a predetermined reference value, the controller 21 detects ink shortage in the corresponding ink tank 43A. The height position of the lower edge 110*t* of the first terminal pin 110*a* according to the fourth embodiment corresponds to a subordinate concept of the detecting position of the present disclosure.

Similar to the tank unit 40A of the first embodiment, the tank unit 40D of the fourth embodiment enhances the detection accuracy of ink. Additionally, the tank unit 40D of the fourth embodiment and the printer provided therewith have various functions and advantageous effects similar to those described in the first embodiment.

E. Fifth Embodiment

Figure 17:
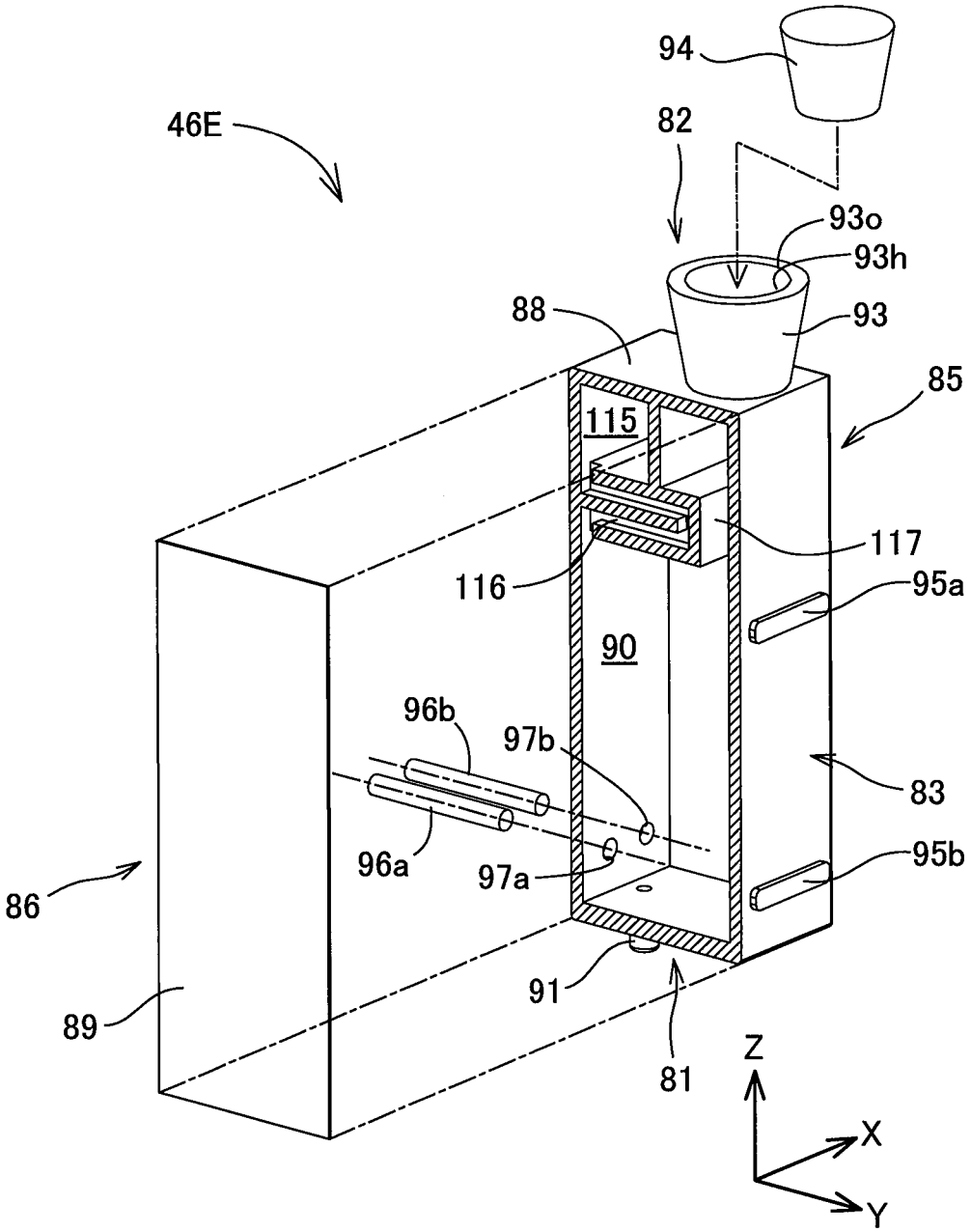
FIG. 17 is a schematic exploded perspective view illustrating an ink cylinder portion according to a fifth embodiment.
Figure 18:
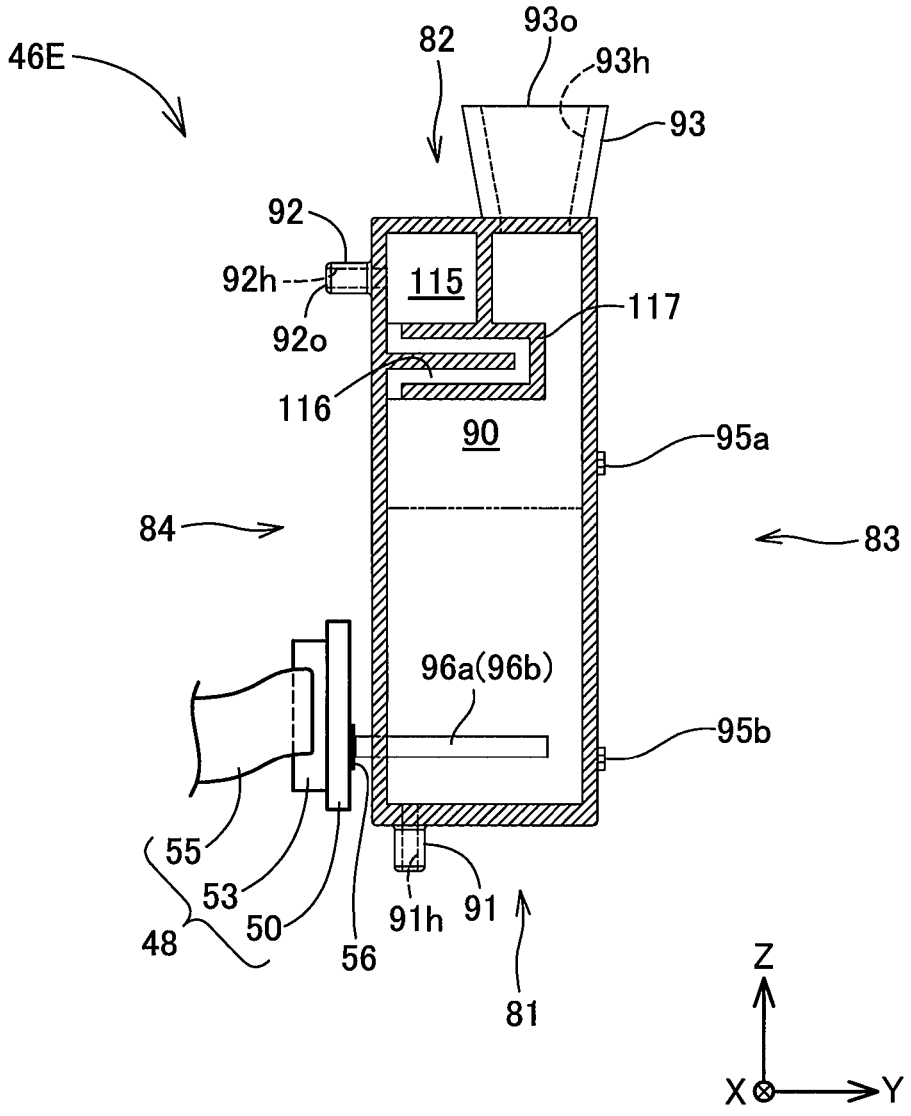
FIG. 18 is a schematic sectional view illustrating the internal configuration of the ink cylinder portion according to the fifth embodiment.

The configuration of an ink cylinder portion 46E included in a tank unit according to a fifth embodiment of the present disclosure is described with reference to FIG. 17 and FIG. 18. FIG. 17 is a schematic exploded perspective view illustrating the ink cylinder portion 46E. FIG. 18 is a schematic sectional view illustrating the internal configuration of the ink cylinder portion 46E. FIG. 18 illustrates a schematic section of the ink cylinder portion 46E taken along a joint surface of a film member 89 as a cutting plane. The tank unit of the fifth embodiment has a substantially similar configuration to that of the tank unit 40A of the first embodiment, except the different configuration of the ink cylinder portion 46E and is mounted to a printer having a similar configuration to that of the printer 10 described in the first embodiment. In the description below and the reference drawings, similar components to those described in the first embodiment or corresponding components are expressed by using the common names and reference signs to those used in the first embodiment.

An air chamber 115 and an air communication passage 116 are provided inside of the ink cylinder portion 46E of the fifth embodiment. The air chamber 115 is a hollow region in an approximately rectangular parallelepiped shape that enables the air to be stored therein and is formed by parting an upper region of an ink chamber 90 by an inner wall portion 117. In the ink cylinder portion 46E, an air introducing portion 92 is arranged to communicate with the air chamber 115.

The air communication passage 116 is formed as a groove that is open on an opposite direction side to the direction of the arrow Y on an end face of the inner wall portion 117. The air communication passage 116 is formed between the air chamber 115 and the ink chamber 90, such that the air chamber 115 communicates with the ink chamber 90. The air communication passage 116 is folded back to go round in the direction of the arrow Y.

In the ink cylinder portion 46E of the fifth embodiment, the air chamber 115 and the air communication passage 116 provided between the ink chamber 90 and the air introducing portion 92 serve to suppress leakage of ink from the ink chamber 90 and vaporization of ink. Additionally, the tank unit of the fifth embodiment including the ink cylinder portion 46E and the printer provided with this tank unit have various functions and advantageous effects similar to those described in the first embodiment.

F. Sixth Embodiment

Figure 19:
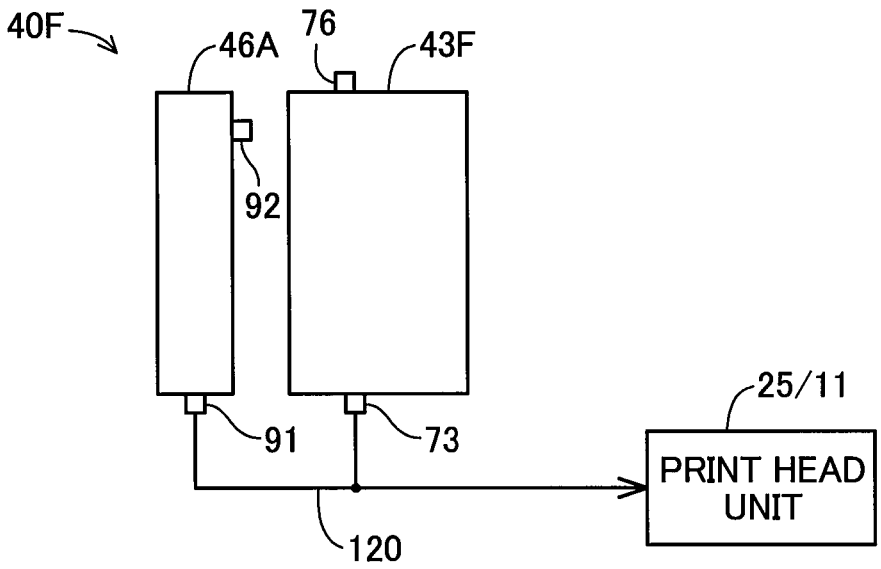
FIG. 19 is a schematic block diagram illustrating the connection configuration of an ink tank and an ink cylinder portion included in a tank unit according to a sixth embodiment.

FIG. 19 is a schematic block diagram illustrating a connection configuration between an ink tank 43F and an ink cylinder portion 46A included in a tank unit 40F according to a sixth embodiment of the present disclosure. The tank unit 40F of the sixth embodiment has a substantially similar configuration to that of the tank unit 40A of the first embodiment, except aspects described below and is mounted to a printer having a similar configuration to that of the printer 10 described in the first embodiment shown in FIGS. 1 and 2. In the description below and the reference drawing, similar components to those described in the first embodiment or corresponding components are expressed by using the common names and reference signs to those used in the first embodiment.

The ink tank 43F included in the tank unit 40F of the sixth embodiment has a substantially similar configuration to that of the ink tank 43A of the first embodiment, except omission of the ink flow portion 75. In the tank unit 40F of the sixth embodiment, a tube 120 is connected with an ink supply portion 73 of the ink tank 43F and with an ink flow portion 91 of the corresponding ink cylinder portion 46A. In the tank unit 40F of the sixth embodiment, the ink tank 43F and the ink cylinder portion 46A are connected via the tube 120 to be parallel to the print head unit 25 of the printing unit 11. The tank unit 40F of the sixth embodiment having this connection configuration also has various functions and advantageous effects similar to those described in the first embodiment. The same applies to the printer provided with the tank unit 40F.

G. Seventh Embodiment

Figure 20:
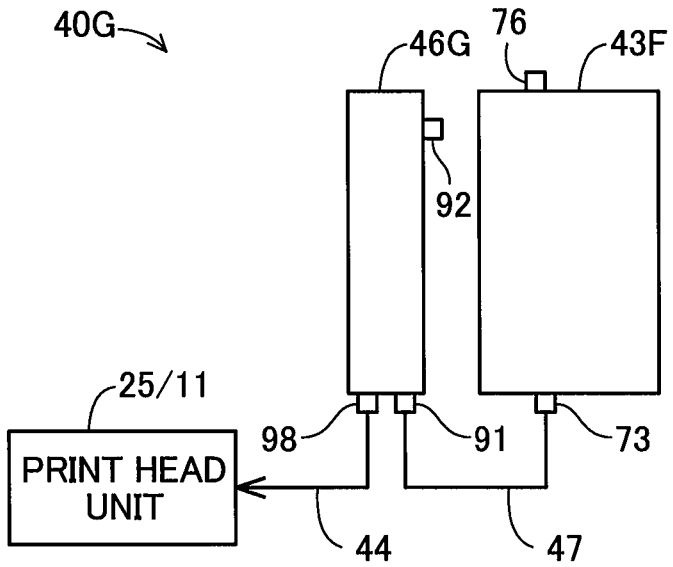
FIG. 20 is a schematic block diagram illustrating the connection configuration of an ink tank and an ink cylinder portion included in a tank unit according to a seventh embodiment.

FIG. 20 is a schematic block diagram illustrating a connection configuration between an ink tank 43F and an ink cylinder portion 46G included in a tank unit 40G according to a seventh embodiment of the present disclosure. The tank unit 40G of the seventh embodiment has a substantially similar configuration to that of the tank unit 40F of the sixth embodiment, except aspects described below and is mounted to a printer having a similar configuration to that of the printer 10 described in the first embodiment shown in FIGS. 1 and 2. In the description below and the reference drawing, similar components to those described in the first embodiment and the sixth embodiment or corresponding components are expressed by using the common names and reference signs to those used in the first embodiment and the sixth embodiment.

The ink cylinder portion 46G included in the tank unit 40G of the seventh embodiment has a substantially similar configuration to that of the ink cylinder portion 46A of the first embodiment, except addition of an ink supply portion 98. The ink supply portion 98 of the ink cylinder portion 46G is formed as a cylindrical region that is protruded downward on the first surface portion 81 and includes a through hole (not shown in the figures) that communicates with the ink chamber 90. The ink supply portion 98 may not be necessarily provided on the first surface portion 81 but may be provided, for example, on a lower edge of the third surface portion 83 or the fourth surface portion 84.

In the tank unit 40G of the seventh embodiment, an ink supply portion 73 of the ink tank 43F and an ink flow portion 91 of the corresponding ink cylinder portion 46G are connected by a tube 47. The ink supply portion 98 of the ink cylinder portion 46G is connected with a print head unit 25 via a tube 44. As described above, in the tank unit 40G of the seventh embodiment, the ink tank 43F and the ink cylinder portion 46G are connected in series such that the ink tank 43F is located on the upstream side and the ink cylinder portion 46G is located on the downstream side. The tank unit 40G of the seventh embodiment having this connection configuration also has various functions and advantageous effects similar to those described in the first embodiment. The same applies to the printer provided with the tank unit 40G.

H. Modifications

The configurations of the respective embodiments described above may be modified appropriately as described below. In the description below, the tank units 40A to 40D, 40F and 40G, the ink tanks 43A, 43B and 43F, and the ink cylinder portions 46A, 46C to 46E and 46G are not distinguished from each other and are called the tank unit 40, the ink tank 43, and the ink cylinder portion 46 unless otherwise specified.

H1. Modification 1

The configurations of the respective embodiments described above may be combined appropriately. For example, in the configuration of any of the third embodiment to the seventh embodiment described above, like the second embodiment shown in FIG. 13, the ink tank 43 and the ink cylinder portion 46 may be connected with each other by means of the tube 103, such as to introduce the air into the ink cylinder portion 46 via the ink tank 43. In another example, the configuration of the detector that detects ink by the optical means described in the above third embodiment shown in FIG. 14, FIG. 15A and FIG. 15B may be applied to any of the fourth embodiment to the seventh embodiment. Additionally, the configuration of the air chamber 115 and the air communication passage 116 shown in FIG. 17 and FIG. 18 included in the ink cylinder portion 46E described in the fifth embodiment may be applied to the ink cylinder portion 46 of the other embodiments.

H2. Modification 2

The tank unit 40 of the respective embodiments described above includes a plurality of ink tanks 43 and a corresponding number of ink cylinder portions 46. According to a modification, the tank unit 40 may include only one ink tank 43 and an ink cylinder portion 46. The ink cylinder portion 46 may be provided corresponding to only part of the plurality of ink tanks 43.

H3. Modification 3

In the respective embodiments described above, the printing unit 11 and the tank unit 40 are separately provided with the different casing portions 12 and 41. According to a modification, the printing unit 11 and the tank unit 40 may be integrally placed in a common casing portion. In the tank unit 40 of the respective embodiments described above, the plurality of ink tanks 43 and the indicator assembly 45 re placed in the casing portion 41. According to a modification, the indicator assembly 45 may be placed outside of the casing portion 41. The indicator assembly 45 may be placed at a position away from the plurality of ink tanks 43. The casing portion 41 may be omitted from the tank unit 40 of the respective embodiments described above. The respective ink tanks 43 and the indicator assembly 45 may be placed to be exposed to the outside. In the respective embodiments described above, the printing unit 11 and the ink unit 40 are coupled with each other. According to a modification, the printing unit 11 and the tank unit 40 may not be coupled with each other or may be placed to be away from each other.

H4. Modification 4

In the respective embodiments described above, the plurality of ink cylinder portions 46 are arranged to be adjacent to each other and to be aligned in the direction of the arrow X on the front face side of the printer 10. According to a modification, the plurality of ink cylinder portions 46 may not be arranged on the front face side of the printer 10 but may be arranged, for example, on a right side face side of the printer 10. The plurality of ink cylinder portions 46 may not be aligned or may not be arranged to be adjacent to each other. For example, the plurality of ink cylinder portions 46 may be arranged in two lines or may be arranged dispersedly.

H5. Modification 5

In the respective embodiments described above, the ink cylinder portion 46 is formed in the approximately rectangular parallelepiped shape. According to a modification, the ink cylinder portion 46 may be formed in a shape other than the approximately rectangular parallelepiped shape. The ink cylinder portion 46 may be formed, for example, in an approximately columnar shape. In the respective embodiments described above, the main body of the ink cylinder portion 46 is comprised of the case member 88 and the film member 89. According to a modification, the main body of the ink cylinder portion 46 may not be comprised of the case member 88 and the film member 89 but, for example, may be comprised of a cylindrical member and a cover member provided to close an opening of the cylindrical member or may be configured by an integrally molded container.

H6. Modification 6

In the respective embodiments described above, the ink chamber 90 of the ink cylinder portion 46 is configured to have substantially the fixed horizontal sectional area along the height direction. According to a modification, the ink chamber 90 of the ink cylinder portion 46 may be configured not to have substantially the fixed horizontal sectional area along the height direction but may be configured to include a partial region of a different horizontal sectional area. According to another modification, the ink chamber 90 of the ink cylinder portion 46 may be partly or entirely configured to decrease or increase the horizontal sectional area in the height direction. The horizontal sectional area of the ink cylinder portion 46 at least at the height of the detecting position where ink is detected should be smaller than the horizontal sectional area of the ink chamber 70 of the ink tank 43 at the corresponding height position.

H7. Modification 7

In the respective embodiments described above, the ink cylinder portion 46 is provided with the ink filling portion 93. According to a modification, the ink cylinder portion 46 may not be provided with the ink filling portion 93. In the respective embodiments described above, the cap member 94 is mounted to the ink filling portion 93 of the ink cylinder portion 46. According to a modification, the cap member 94 of the ink filling portion 93 may be omitted. In the respective embodiments described above, the third surface portion 83 of the ink cylinder portion 46 is configured as the visible portion that causes the position of the liquid level of ink in the ink chamber 90 to be visible from the outside. According to a modification, the ink cylinder portion 46 may not have any portion, such as the third surface portion 83, that causes the position of the liquid level of ink to be visible from the outside. The ink cylinder portion 46 is provided with the two marks 95*a* and 95*b* on the third surface portion 83 serving as the visible portion. Both the two marks 95*a* and 95*b* may be omitted, or either one of the two marks 95*a* and 95*b* may be omitted. A scale indicating the amount of ink may be formed, in place of the marks 95*a* and 95*b* indicating the upper limit position and the lower limit position of the liquid level of ink.

H8. Modification 8

In the respective embodiments described above, the ink flow portion 91 of the ink cylinder portion 46 is provided on the lower edge of the ink cylinder portion 46. According to a modification, the ink flow portion 91 may not be provided on the lower edge of the ink cylinder portion 46. The ink flow portion 91 may be formed at any position that enables the ink from the corresponding ink tank 43 to flow into the ink chamber 90. It is desirable to provide the ink flow portion 91 at a position that enables the ink in the ink chamber 90 to flow out toward the ink tank 43.

H9. Modification 9

In the respective embodiments described above, the terminal connecting assembly 48 or the optical sensor structure 106 includes the substrate portion 40 that is arranged to face each of the plurality of ink cylinder portions 46. According to a modification, the terminal connecting assembly 48 or the optical sensor structure 106 may not include the substrate portion 40. One terminal connecting assembly 48 may be provided separately for each of the pair of terminal pins 96*a* and 96*b* included in each of the ink cylinder portions 46. Similarly one set of the light-emitting element 107 and the light-receiving element 108 of the optical sensor structure 106 may be placed separately for each of the plurality of ink cylinder portions 46.

H10. Modification 10

In the tank unit 40 of the above embodiments, the ink tank 43 may have another configuration. The ink tank 43 may not be provided with the ink filling portion 72. The ink tank 43 may not be provided with the air chamber 71 or may not be provided with the air communication passage 74. The ink tank 43 may be configured to include only either one of the air chamber 71 and the air communication passage 74 or may be configured such that the air introducing portion 76 is directly connected with the ink chamber 70. The ink tank 43 may not include the lower edge structure 70*b* of the ink chamber 70. In the ink tank 43, the ink supply portion 73 and the ink flow portion 75 may not be provided parallel to each other but may be protruded respectively in different directions. The ink supply portion 73 and the ink flow portion 75 may be provided at different height positions.

H11. Modification 11

The tank unit 40 of the respective embodiments described above includes the plurality of ink tanks 43 having the same capacity and the same shape. According to a modification, the tank unit 40 may include a plurality of ink tanks 43 having different capacities. In the tank unit 40 of the above embodiments, the plurality of ink tanks 43 are aligned. According to a modification, the ink tanks 43 may not be aligned. For example, the plurality of ink tanks 43 may be arranged in two lines or may be arranged dispersedly.

H12. Modification 12

In the above fourth embodiment shown in FIG. 16, the controller 21 detects ink shortage in the ink tank 43A when the liquid level of ink decreases to be lower than the lower edge 110*t* of the first terminal pin 110*a* and the signal processor 22 detects an increase of the resistance that is equal to or greater than the reference value. According to a modification, in the configuration of the tank unit 40D of the fourth embodiment, the controller 21 may detect the amount of ink contained in the ink tank 43A, based on a change in the resistance between the first terminal pin 110*a* and the second terminal pin 110*b*. The amount of ink may be detected, for example, by the following configuration. The controller 21 reads in advance a map of setting an unequivocal relationship of the resistance between the first terminal pin 110*a* and the second terminal pin 110*b* to the position of the liquid level of ink in the ink chamber 70 of the ink tank 43A, from a nonvolatile storage device or the like. When the signal processor 22 detects the resistance between the first terminal pin 110*a* and the second terminal pin 110*b*, the controller 21 refers to this map and obtains the position of the liquid level of ink corresponding to the detected current resistance. This configuration allows for detection of the amount of ink contained in the ink tank 43A. In this configuration that detects the amount of ink, the entire range where the respective terminal pins 110*a* and 110*b* are placed in the ink chamber 70 corresponds to a subordinate concept of the detecting position of the present disclosure. In the configuration of detecting the amount of ink by the ink detector, it is desirable that the horizontal sectional area in the ink chamber 90 of the ink cylinder portion 46 is smaller than the horizontal sectional area in the ink chamber 70 of the corresponding ink tank 43 over the range of detection where the position of the liquid level of ink is detected.

H13. Modification 13

In the above second embodiment, the ink chamber 90 of the ink cylinder portion 46A is connected with the air chamber 71 of the ink tank 43B via the tube 103 as shown in FIG. 13. According to a modification, the ink chamber 90 of the ink cylinder portion 46A may be connected with an upper region of the ink chamber 70 of the ink tank 43B via the tube 103. This configuration enables the ink that is excessively injected over the upper limit when the user supplies ink from the ink filling portion 93 into the ink cylinder portion 46A, to flow through the tube 103 into the ink chamber 70 of the ink tank 43A.

H14. Modification 14

In the respective embodiments described above, the tank unit 40 includes the plurality of ink tanks 43 and is configured to supply ink to the printer 10 that consumes the ink. According to a modification, the configuration of the tank unit 40 in each of the embodiments may be applied to a tank unit that causes a liquid other than ink to be supplied to a liquid consuming apparatus that consumes the liquid. For example, the configuration of the tank unit 40 may be applied to a tank unit including a detergent tank that supplies a liquid detergent to a detergent injection apparatus configured to inject the detergent. The liquid consuming apparatus that ejects or injects the liquid and consumes the liquid, like the printer 10, is one embodiment of the liquid injection apparatus.

The present disclosure is not limited to any of the embodiments, the examples and the modifications described above but may be implemented by a diversity of configurations without departing from the scope of the disclosure. For example, the technical features of any of the embodiments, the examples and the modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

The present application claims priority from Japanese patent application 2015-70897 filed on Mar. 31, 2015 as the basis, the entirety of the disclosure of which is hereby incorporated by reference into this application.

REFERENCE SIGNS LIST

10 . . . printer, 11 . . . printing unit, 12 . . . casing portion, 13 . . . paper feed slot, 14 . . . paper ejection slot, 15 . . . interface portion, 16 . . . side surface portion, 19 . . . screw, 20 . . . internal unit, 21 . . . controller, 22 . . . signal processor, 23 . . . image forming unit, 24 . . . paper conveying mechanism, 25 . . . print head unit, 26 . . . head driving portion, 30 . . . carriage, 31 . . . ink ejection head, 32 . . . relay unit, 35 . . . motor, 36 . . . endless belt, 37 . . . guide rail, 40, 40A-40D, 40F, 40G . . . tank unit, 41 . . . casing portion, 41*a* . . . bottom plate portion, 41*b* . . . box body portion, 42*a*-42*d* . . . windows, 43, 43A, 43B, 43F . . . ink tank, 44 . . . tube, 45 . . . indicator assembly, 46, 46A, 46C-46E, 46G . . . ink cylindrical portion, 47 . . . tube, 48 . . . terminal connecting assembly, 50 . . . substrate portion, 51, 52 . . . substrate surfaces, 53 . . . cable connecting portion, 55 . . . wiring cable, 56 . . . terminal, 61-66 . . . surface portions of ink tank, 68 . . . case member, 69 . . . film member, 70 . . . ink chamber, 70*b* . . . lower edge structure, 71 . . . air chamber, 72 . . . ink filling portion, 72*h* . . . through hole, 72*o* . . . fill port, 73 . . . ink supply portion, 73*h* . . . through hole, 74 . . . air communication passage, 75 . . . ink flow portion, 75*h* . . . through hole, 76 . . . air introducing portion, 76*h* . . . through hole, 76*o* . . . air release port, 78*a*, 78*b* . . . marks, 79 . . . cap member, 81-86 . . . , surface portions of ink cylinder portion, 88 . . . case member, 89 . . . film member, 90 . . . ink chamber, 91 . . . ink flow portion, 91*h* . . . through hole, 92 . . . air introducing portion, 92*h* . . . through hole, 92*o* . . . air release port, 93 . . . ink filling portion, 93*h* . . . through hole, 93*o* . . . fill port, 94 . . . cap member, 95*a*, 95*b* . . . marks, 96*a*, 96*b* . . . terminal pins, 97*a*, 97*b* . . . through holes, 98 . . . ink supply portion, 101 . . . air flow portion, 102 . . . through hole, 103 . . . tube, 105 . . . triangular prism, 105*a*-105*c* . . . surfaces, 106 . . . optical sensor structure, 107 . . . light-emitting element, 108 . . . light-receiving element, 110*a*, 110*b* . . . terminal pins, 110*t* . . . lower edge, 111*a*, 111*b* . . . through holes, 115 . . . air chamber, 116 . . . air communication passage, 117 . . . inner wall portion, 120 . . . tube

The invention claimed is:

1. A liquid supply apparatus configured to supply a liquid to a liquid consuming apparatus, the liquid supply apparatus comprising:

a first liquid container provided to contain the liquid and configured to introduce the air into the first liquid container, the first liquid container includes a first fill port configured to accept the liquid to be injected into the first liquid container from outside of the first liquid container and a first seal member configured to seal the first fill port;

a second liquid container provided to contain the liquid and configured to communicate with the first liquid container so that the liquid in the first liquid container flows into the second liquid container and to introduce the air into the second liquid container, the second liquid container includes a second fill port configured to accept the liquid to be injected into the second liquid container from outside of the second liquid container and a second seal member configured to seal the second fill port; and a detector configured to detect the liquid contained in the second liquid container, wherein a sectional area of a horizontal section of the second liquid container at a detecting position where the detector detects the liquid is smaller than a sectional area of a horizontal section of the first liquid container at a height position corresponding to the detecting position.

2. The liquid supply apparatus according to claim 1, wherein the detecting position is located on a lower edge side that is nearer to a lower edge than an upper edge of the second liquid container in direction of gravity, and the detector detects presence or absence of the liquid at the detecting position.

3. The liquid supply apparatus according to claim 1, wherein the second liquid container includes a visible portion configured to cause a user to visually recognize position of a liquid level of the liquid from outside.

4. The liquid supply apparatus according to claim 1, wherein an air flow passage is provided between the second liquid container and the first liquid container so that the air flows between the second liquid container and the first liquid container.

5. The liquid supply apparatus according to claim 4, wherein the first liquid container includes a liquid chamber configured to contain the liquid, and an air chamber configured to communicate with the liquid chamber and to contain the air, wherein the air flow passage is connected with the air chamber.

6. The liquid supply apparatus according to claim 1, wherein the second liquid container includes a liquid chamber configured to contain the liquid, an air release port configured to be open toward outside, and an air communication passage extended from the air release port toward the liquid chamber and configured to flow the air to be introduced into the liquid chamber.

7. The liquid supply apparatus according to claim 1, comprising multiple sets of the first liquid container and the second liquid container in pair, wherein a first liquid container array is configured by a plurality of the first liquid containers arranged in a line in a first direction, and a second liquid container array is configured by a plurality of the second liquid containers arranged in a line in a second direction orthogonal to the first direction.

8. The liquid supply apparatus according to claim 7, wherein the second liquid container array is placed at a position adjoining to the first liquid container array in the first direction, and a width of the second liquid container array in the second direction is smaller than a width of the first liquid container array in the second direction.

9. The liquid supply apparatus according to claim 8, wherein the detector includes a detection element placed inside of the second liquid container and a connecting assembly placed outside of the second liquid container and configured to transmit a signal to and from the detection element, wherein the connecting assembly is placed between the first liquid container array and the second liquid container array and includes a substrate portion facing an end portion of the first liquid container array and arranged along the second liquid container array.

10. A liquid consuming apparatus, comprising:

the liquid supply apparatus according to claim 1; and a liquid consuming portion configured to consume the liquid supplied from the liquid supply apparatus.

11. The liquid consuming apparatus according to claim 10, wherein the second liquid container is placed on a front face side of the liquid consuming apparatus.

* * * * *